United States Patent [19]

Honda et al.

[11] Patent Number: 4,740,440

[45] Date of Patent: Apr. 26, 1988

[54] AMORPHOUS SILICON MULTILAYERED PHOTOSENSITIVE ELEMENT CONTAINING SPHERICAL-DIMPLED SUBSTRATE SURFACE

[75] Inventors: Mitsuru Honda; Atsushi Koike, both of Chiba; Kyosuke Ogawa, Miye; Keiichi Murai, Chiba, all of Japan

[73] Assignee: Canon Kabushiki Kaisha, Tokyo, Japan

[21] Appl. No.: 920,143

[22] Filed: Oct. 16, 1986

[30] Foreign Application Priority Data

Oct. 16, 1985 [JP] Japan ..... 60-228738

[51] Int. Cl.[4] ..... G03G 5/14

[52] U.S. Cl. ..... 430/60; 430/945; 430/66

[58] Field of Search ..... 430/60, 66, 945

[56] References Cited

U.S. PATENT DOCUMENTS 4,618,552 10/1986 Tanaka ..... 430/60

*Primary Examiner*—J. David Welsh

*Attorney, Agent, or Firm*—Fitzpatrick, Cella, Harper & Scinto

[57] ABSTRACT

There is provided a light receiving member which comprises a support, a photosensitive layer and a surface layer, said photosensitive layer being composed of amorphous material containing silicon atoms, and at least either germanium atoms or tin atoms and said surface layer being composed of amorphous material containing silicon atoms and at least one kind selected from oxygen atoms, carbon atoms and nitrogen atoms, said support having a surface provided with irregularities composed of spherical dimples, and an optical band gap being matched at the interface between said photosensitive layer and said surface layer. The light receiving member overcomes all of the problems in the conventional light receiving member comprising a light receiving layer composed of an amorphous silicon and, in particular, effectively prevents the occurrence of interference fringe in the formed images due to the interference phenomenon thereby forming visible images of excellent quality even in the case of using coherent laser beams possible producing interference as a light source.

14 Claims, 32 Drawing Sheets

(A)

(B)

(A)

(B)

AMORPHOUS SILICON MULTILAYERED PHOTOSENSITIVE ELEMENT CONTAINING SPHERICAL-DIMPLED SUBSTRATE SURFACE

BACKGROUND OF THE INVENTION

1. Field of the Invention:

This invention concerns light receiving members being sensitive to electromagnetic waves such as light (which herein means in a broader sense those lights such as ultraviolet rays, visible rays, infrared rays, X-rays, and $\gamma$-rays). More specifically, the invention relates to improved light receiving members suitable particularly for use in the cases where coherent lights such as laser beams are applied.

2. Description of the Prior Art:

For the recording of digital image information, there has been known such methods as forming electrostatic latent images by optically scanning a light receiving member with laser beams modulated in accordance with the digital image information, and then developing the latent images or further applying transfer, fixing or like other treatment as required. Particularly, in the method of forming images by an electrophotographic process, image recording has usually been conducted by using a He-Ne laser or a semiconductor laser (usually having emission wavelength at from 650 to 820 nm), which is small in size and inexpensive in cost as the laser source.

As the light receiving members for electrophotography being suitable for use in the case of using the semiconductor laser, those light receiving members comprising amorphous materials containing silicon atoms (hereinafter referred to as "a-Si"), for example, as disclosed in Japanese Patent Laid-Open Nos. 86341/1979 and 83746/1981, have been evaluated as being worthy of attention. They have a high Vickers hardness and cause less problems in the public pollution, in addition to their excellent matching property in the photosensitive region as compared with other kinds of known light receiving members.

However, when the light receiving layer constituting the light receiving member as described above is formed as an a-Si layer of monolayer structure, it is necessary to structurally incorporate hydrogen or halogen atoms or, further, boron atoms within a range of specific amount into the layer in order to maintain the required dark resistance of greater than $10^{12}$ $\Omega$cm for electrophotography while maintaining their high photosensitivity. Therefore, the degree of freedom for the design of the light receiving member undergoes a rather severe limit such as the requirement for the strict control for various kinds of conditions upon forming the layer. Then, there have been made several proposals to overcome such problems for the degree of freedom in view of the design in that the high photosensitivity can effectively be utilized while reducing the dark resistance to some extent. That is, the light receiving layer is so constituted as to have two or more layers prepared by laminating those layers for different conductivity in which a depletion layer is formed to the inside of the light receiving layer as disclosed in Japanese Patent Laid-Open Nos. 171743/1979, 4053/1982 and 4172/1982, or the apparent dark resistance is improved by providing a multi-layered structure in which a barrier layer is disposed between the support and the light receiving layer and/or on the upper surface of the light receiving layer as disclosed, for example, in Japanese Patent Laid-Open Nos. 52178/1982, 52179/1982, 52180/1982, 58159/1982, 58160/1982, and 58161/1982.

However, such light receiving members as having a light receiving layer of multi-layered structure have unevenness in the thickness for each of the layers. In the case of conducting the laser recording by using such members, since the laser beams comprise coherent monochromatic light, the respective light beams reflected from the free surface of the light receiving layer on the side of the laser beam irradiation and from the layer boundary between each of the layers constituting the light receiving layer and between the support and the light receiving layer (hereinafter both of the free surface and the layer interface are collectively referred to as "interface") often interfere with each other.

The interference results in a so-called interference fringe pattern in the formed images which brings about defective images. Particularly, in the case of intermediate tone images with high gradation, the images obtained become extremely poor in quality.

In addition, as an important point there exist problems that the foregoing interference phenomenon will become remarkable due to that the absorption of the laser beams in the light receiving layer is decreased as the wavelength region of the semiconductor laser beams used is increased.

That is, in the case of two or more layer (multi-layered) structure, interference effects occur as for each of the layers, and those interference effects synergistically interact with each other to exhibit interference fringe patterns, which directly influence the transfer member thereby to transfer and fix the interference fringe on the member, and thus bringing about defective images in the visible images corresponding to the interference fringe pattern.

In order to overcome these problems, there have been proposed, for example,(a) a method of cutting the surface of the support with diamond means to form a light scattering surface formed with unevenness of $\pm 500$ to $\pm 10{,}000$ (refer, for example, to Japanese Patent Laid-Open No. 162975/1983), (b) a method of disposing a light absorbing layer by treating the surface of an aluminum support with black alumite or by dispersing carbon, colored pigment, or dye into a resin (refer, for example, to Japanese Patent Laid-Open No. 165845/1982), and (c) a method of disposing a light scattering reflection preventing layer on an aluminum support by treating the surface of the support with a satin-like alumite processing or by disposing a fine grain-like unevenness by means of sand blasting (refer, for example, to Japanese Patent Laid-Open No. 16554/1982).

Although these proposed methods provide satisfactory results to some extent, they are not sufficient for completely eliminating the interference fringe pattern formed in the images.

That is, in the method (a), since a plurality of irregularities with a specific t are formed at the surface of the support, occurrence of the interference fringe pattern due to the light scattering effect can be prevented to some extent. However, since the regular reflection light component is still left as the light scattering, the interference fringe pattern due to the regular reflection light still remains and, in addition, the irradiation spot is widened due to the light scattering effect at the support surface to result in a substantial reduction in the resolving power.

In the method (b), it is impossible to obtain complete absorption only by the black alumite treatment, and the reflection light still remains at the support surface. And in the case of disposing the resin layer dispersed with the pigment, there are various problems; degasification is caused from the resin layer upon forming an a-Si layer to invite a remarkable deterioration on the quality of the resulting light receiving layer: the resin layer is damaged by the plasmas upon forming the a-Si layer wherein the inherent absorbing function is reduced and undesired effects are given to the subsequent formation of the a-Si layer due to the worsening in the surface state.

In the method (c), referring to incident light for instance, a portion of the incident light is reflected at the surface of the light receiving layer to be a reflected light, while the remaining portion intrudes as the transmitted light to the inside of the light receiving layer. And a portion of the transmitted light is scattered as a diffused light at the surface of the support and the remaining portion is regularly reflected as a reflected light, a portion of which goes out as the outgoing light. However, the outgoing light is a component to interfere with the reflected light. In any event, since the light remains, the interference fringe pattern cannot be completely eliminated.

For preventing the interference in this case, attemps have been made to increase the diffusibility at the surface of the support so that no multi-reflection occurs at the inside of the light receiving layer. However, this somewhat diffuses the light in the light receiving layer thereby causing halation and, accordingly, reducing the resolving power.

Particularly, in the light receiving member of the multilayered structure, if the support surface is roughened irregularly, the reflected light at the surface of the first layer, the reflected light at the second layer, and the regular reflected light at the support surface interfere with one another which results in the interference fringe pattern in accordance with the thickness of each layer in the light receiving member. Accordingly, it is impossible to completely prevent the interference fringe by unevenly roughening the surface of the support in the light receiving member of the multi-layered structure.

In the case of unevenly roughening the surface of the support by sand blasting or like other method, the surface roughness varies from one lot to another and the unevenness in the roughness occurs even in the same lot thereby causing problems in view of the production control. In addition, relatively large protrusions are frequently formed at random and such large protrusions cause local breakdown in the light receiving layer.

Further, even if the surface of the support is regularly roughened, since the light receiving layer is usually deposited along the uneven shape at the surface of the support, the inclined surface on the unevenness at the support are in parallel with the inclined surface on the unevenness at the light receiving layer, where the incident light brings about bright and dark areas. Further, in the light receiving layer, since the layer thickness is not uniform over the entire light receiving layer, a dark and bright stripe pattern occurs. Accordingly, mere orderly roughening the surface of the support cannot completely prevent the occurrence of the interference fringe pattern.

Furthermore, in the case of depositing the light receiving layer of multi-layered structure on the support having the surface which is regularly roughened, since the interference due to the reflected light at the interface between the layers is joined to the interference between the regular reflected light at the surface of the support and the reflected light at the surface of the light receiving layer, the situation is more complicated than the occurrence of the interference fringe in the light receiving member of single layer structure.

SUMMARY OF THE INVENTION

The object of this invention is to provide a light receiving member comprising a light receiving layer mainly composed of a-Si, free from the foregoing problems and capable of satisfying various kinds of requirements.

That is, the main object of this invention is to provide a light receiving member comprising a light receiving layer constituted with a-Si in which electrical, optical, and photoconductive properties are always substantially stable scarcely depending on the working circumstances, and which is excellent against optical fatigue, causes no degradation upon repeating use, excellent in durability and moisture-proofness, exhibits no or scarce residual potential and provides easy production control.

Another object of this invention is to provide a light receiving member comprising a light receiving layer composed of a-Si which has a high photosensitivity in the entire visible region of light, particularly, an excellent matching property with a semiconductor laser, and shows quick light response.

Other object of this invention is to provide a light receiving member comprising a light receiving layer composed of a-Si which has high photosensitivity, high S/N ratio, and high electrical voltage withstanding property.

A further object of this invention is to provide a light receiving member comprising a light receiving layer composed of a-Si which is excellent in the close bondability between the support and the layer disposed on the support or between the laminated layers, strict and stable in that of the structural arrangement and of high layer quality.

A further object of this invention is to provide a light receiving member comprising a light receiving layer composed of a-Si which is suitable to the image formation by using coherent light, free from the occurrence of interference fringe pattern and spot upon reversed development even after repeating use for a long period of time, free from defective images or blurring in the images, shows high density with clear half tone, and has a high resolving power, and can provide high quality images.

These and other objects, as well as the features of this invention will become apparent by reading the following descriptions of preferred embodiments according to this invention while referring to the accompanying drawings.

BRIEF DESCRIPTION OF THE DRAWINGS

FIG. 2 is a view illustrating that the occurrence of the interference fringe can be prevented in the light receiving member in which unevenness constituted with spherical dimples is formed to the surface of the support, and FIG. 3 is a view illustrating that the interference fringe occurs in the conventional light receiving member in which the light receiving layer is deposited on the support roughened regularly at the surface.

FIG. 6 is a chart schematically illustrating a constitutional example of a device suitable for forming the uneven shape formed to the support of the light receiving member according to this invention, in which FIG. 6(A) is a front elevational view, and FIG. 6(B) is a vertical cross-sectional view.

DETAILED DESCRIPTION OF THE INVENTION

The present inventors have made earnest studies for overcoming the foregoing problems on the conventional light receiving members and attaining the objects as described above and, as a result, have accomplished this invention based on the findings as described below.

That is, this invention relates to a light receiving member which is characterized in that a support having a surface provided with irregularities composed of spherical dimples has, thereon, a light receiving layer having a photosensitive layer being composed of amorphous material containing silicon atoms and at least either germanium atoms or tin atoms and a surface layer being composed of amorphous material containing silicon atoms and at least one kind selected from oxygen atoms, carbon atoms and nitrogen atoms in which an optical band gap being matched at the interface between said photosensitive layer and said surface layer.

By the way, the gists of the findings that the present inventors obtained after earnest studies are as follows:

That is, one is that in a light receiving member being equipped with a light receiving layer having a photosensitive layer and a surface layer on the support, in a case where the optical band gap possessed by the surface layer and the optical band gap possessed by the photosensitive layer to which the surface layer is disposed directly are matched at the interface between the surface layer and the photosensitive layer, occurrence of reflection of the incident light at the interface between the surface layer and the photosensitive layer can be prevented, and the problems such as interference fringes or uneven sensitivity resulted from the uneven layer thickness upon forming the surface layer and/or uneven layer thickness due to the abrasion of the surface layer can be overcome.

The other is that the problems for the interference fringe pattern occurring upon image formation in the light receiving member having a plurality of layers on a support can be overcome by disposing unevenness constituted with a plurality of spherical dimples on the surface of the support.

Now, these findings are based on the facts obtained by various experiments carried out by the present inventors.

To help understand the foregoing, the following explanation will be made with reference to the drawings.

Figure 1:
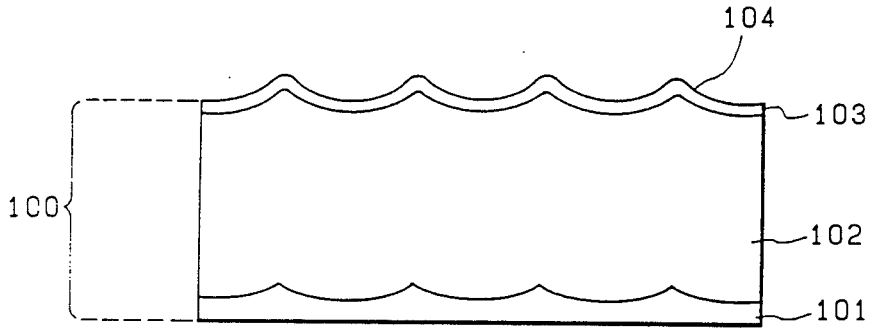
FIG. 1 is a view of schematically illustrating one example of the light receiving members according to this invention.

FIG. 1 is a schematic view illustrating the layer structure of the light receiving member 100 pertaining to this invention. The light receiving member is made up of the support 101, a photosensitive layer 102 and a surface layer 103 respectively formed thereon. The support 101 has irregularities resembling a plurality of fine spherical dimples on the surface thereof. The photosensitive layer 102 and the surface layer 103 are formed along the slopes of the irregularities.

Figure 2:
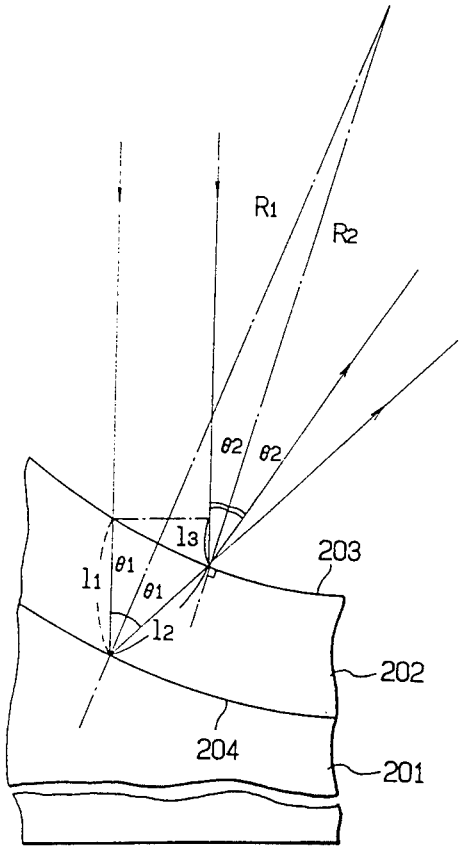
FIGS. 2 and 3 are enlarged portion views for illustrating the principle of preventing the occurrence of interference fringe in the light receiving member according to this invention.
Figure 3:
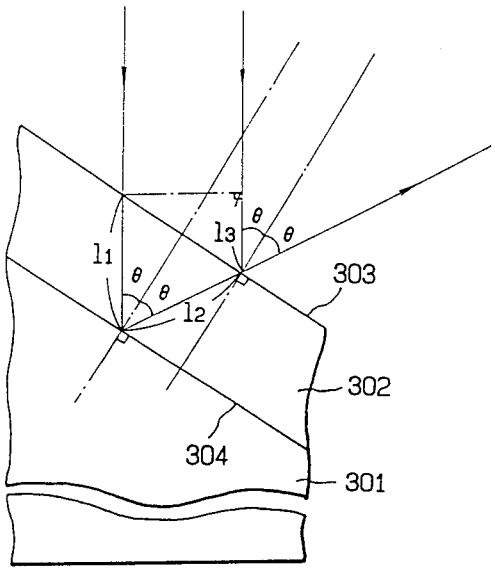

FIGS. 2 and 3 are views explaining how the problem of interference infringe pattern is solved in the light receiving member of this invention.

FIG. 3 is an enlarged view for a portion of a conventional light receiving member in which a light receiving layer of a multi-layered structure is deposited on the support, the surface of which is regularly roughened. In the drawing, 301 is a photosensitive layer, 302 is a surface layer, 303 is a free surface and 304 is an interface between the photosensitive layer and the surface layer. As shown in FIG. 3, in the case of merely roughening the surface of the support regularly by grinding or like other means, since the light receiving layer is usually formed along the uneven shape at the surface of the support, the slope of the unevenness at the surface of the support and the slope of the unevenness of the light receiving layer are in parallel with each other.

Owing to the parallelism, the following problems always occur, for example, in a light receiving member of multi-layered structure in which the light receiving layer comprises two layers, that is, the photosensitive layer 301 and the surface layer 302. Since the interface 304 between the photosensitive layer and the surface layer is in parallel with the free surface 303, the direction of the reflected light $R_1$ at the interface 304 and that of the reflected light $R_2$ at the free surface coincide with each other and, accordingly, an interference fringe occurs depending on the thickness of the surface layer.

FIG. 2 is an enlarged view for a portion shown in FIG. 1. As shown in FIG. 2, an uneven shape composed of a plurality of fine spherical dimples are formed at the surface of the support in the light receiving member according to this invention and the light receiving layer thereover is deposited along the uneven shape. Therefore, in the light receiving member of the multi-layered structure, for example, in which the light receiving layer comprises a photosensitive layer 201 and a surface layer 202, the interface 204 between the photo-sensitive layer 201 and the surface layer 202 and the free surface 203 are respectively formed with the uneven shape composed of the spherical dimples along the uneven shape at the surface of the support. Assuming the radius of curvature of the spherical dimples formed at the interface 204 as $R_1$ and the radius of curvature of the spherical dimples formed at the free surface as $R_2$, since $R_1$ is not identical with $R_2$, the reflection light at the interface 204 and the reflection light at the free surface 203 have reflection angles different from each other, that is, $\theta_1$ is not identical with $\theta_2$ in FIG. 2 and the direction of their reflection lights are different. In addition, the deviation of the wavelength represented by $l_1+l_2-l_3$ by using $l_1$, $l_2$, and $l_3$ shown in FIG. 2 is not constant but variable, by which a sharing interference corresponding to the so-called Newton ring phenomenon occurs and the interference fringe is dispersed within the dimples. Then, if the interference ring should appear in the microscopic point of view in the images caused by way of the light receiving member, it is not visually recognized.

That is, in a light receiving member having a light receiving layer of multi-layered structure formed on the support having such a surface shape, the fringe pattern resulted in the images due to the interference between lights passing through the light receiving layer and reflecting on the layer interface and at the surface of the support thereby enabling to obtain a light receiving member capable of forming excellent images.

By the way, the radius of curvature R and the width D of the uneven shape formed by the spherical dimpels, at the surface of the support of the light receiving member according to this invention constitute an important factor for effectively attaining the advantageous effect of preventing the occurrence of the interference fringe in the light receiving member according to this invention. The present inventors carried out various experiments and, as a result, found the following facts.

That is, if the radius of curvature R and the width D satisfy the following equation:

$$D/R \geqq 0.035$$

0.5 or more Newton rings due to the sharing interference are present in each of the dimples. Further, if they satisfy the following equation:

$$D/R \geqq 0.055$$

one or more Newton rings due to the sharing interference are present in each of the dimples.

From the foregoing, it is preferred that the ratio D/R is greater than 0.035 and, preferably, greater than 0.055 for dispersing the interference fringes resulted throughout the light receiving member in each of the dimples thereby preventing the occurrence of the interference fringe in the light receiving member.

Further, it is desired that the width D of the unevenness formed by the scraped dimple is about 500 μm at the maximum, preferably, less than 300 μm and, more preferably less than 100 μm.

The light receiving layer of the light receiving member which is disposed on the support having the particular surface as above-mentioned in this invention is constituted by the photosensitive layer and the surface layer. The photosensitive layer is composed of amorphous material containing silicon atoms and at least either germanium atoms or tin atoms, particularly preferably, of amorphous material containing silicon atoms (Si), at least either germanium atoms (Ge) or tin atoms (Sn), and at least either hydrogen atoms (H) or halogen atoms (X) [hereinafter referred to as "a-Si (Ge, Sn) (H, X)"] or of a-Si (Ge, Sn)(H, X) containing at least one kind selected from oxygen atoms (O), carbon atoms, (C) and nitrogen atoms (N) [hereinafter referred to as "a-Si (Ge, Sn) (O, C, N)(H, X)"]. And said amorphous materials may contain one or more kinds of substances control the conductivity in the case where necessary.

The photosensitive layer may be a multi-layered structure and, particularly preferably, it includes a so-called barrier layer composed of a charge injection inhibition layer and/or electrically insulating material containing a substance for controlling the conductivity as one of the constituent layers.

As for the surface layer, it is composed of amorphous material containing silicon atoms, and at least one kind selected from oxygen atoms, carbon atoms and nitrogen atoms, and particularly preferably, of amorphous material containing silicon atoms (Si), at least one kind selected from oxygen atoms (O), carbon atoms (C) and nitrogen atoms (N), and at least either hydrogen atoms (H) or halogen atoms [hereinafter referred to as "a-Si (O, C, N)(H, X)"].

For the preparation of the photosensitive layer and the surface layer of the light receiving member according to this invention, because of the necessity of precisely controlling their thicknesses at an optical level in order to effectively achieve the foregoing objects of this invention there is usually used vacuum deposition technique such as glow discharging method , sputtering method or ion plating method, but light CVD method and heat CVD method may be also employed.

The light receiving member according to this invention will now be explained more specifically referring to the drawings. The description is not intended to limit the scope of the invention.

FIG. 1 is a schematic view for illustrating the typical layer structure of the light receiving member of this invention, in which are shown the light receiving member 100, the support 101, the photosensitive layer 102, the surface layer 103 and the free surface 104.

Support

The support 101 in the light receiving member according to this invention has a surface with fine unevenness smaller than the resolution power required for the light receiving member and the unevenness is composed of a plurality of spherical dimples.

Figure 4:
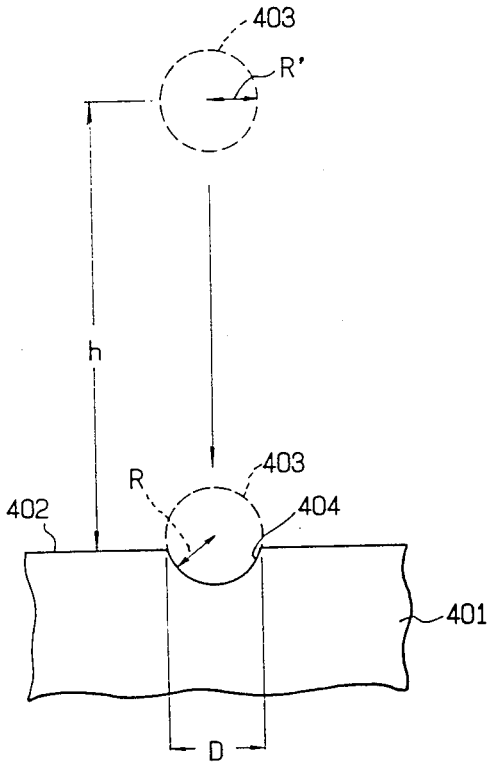
FIGS. 4 and 5A, B and C are schematic views for illustrating the uneven shape at the surface of the support of the light receiving member according to this invention and a method of preparing the uneven shape.
Figure 5:
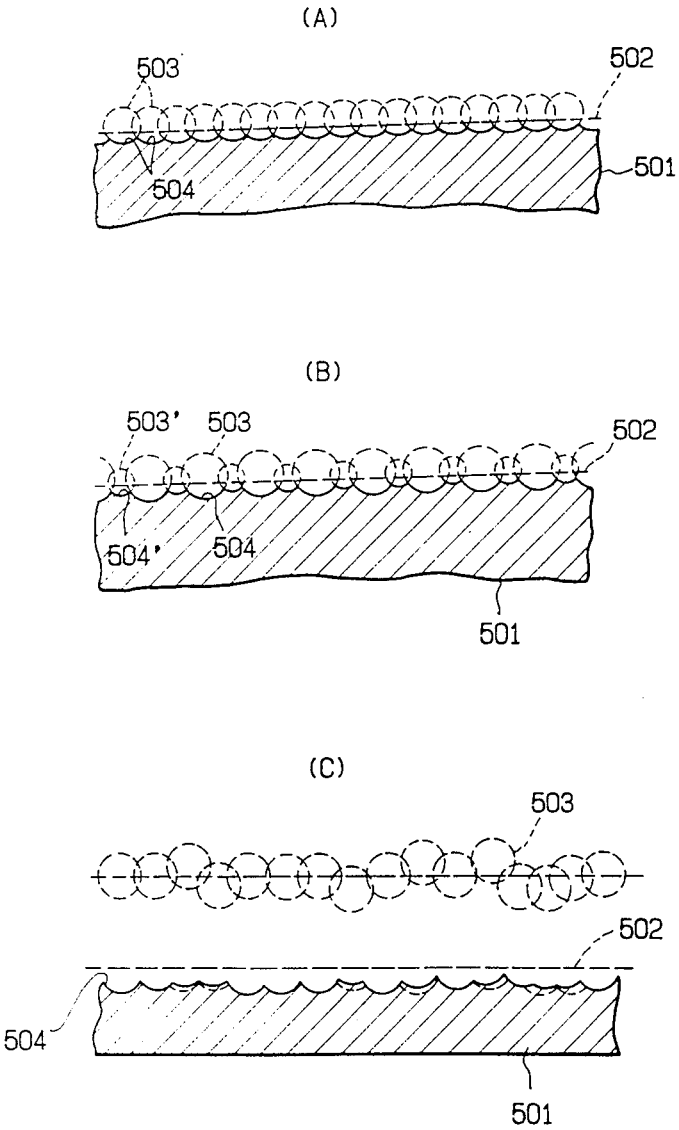

The shape of the surface of the support and an example of the preferred methods of preparing the shape are specifically explained referring to FIGS. 4 and 5 but it should be noted that the shape of the support in the light receiving member of this invention and the method of preparing the same are no way limited only thereto.

FIG. 4 is a schematic view for a typical example of the shape at the surface of the support in the light receiving member according to this invention, in which a portion of the uneven shape is enlarged. In FIG. 4, are shown a support 401, a support surface 402, a rigid true sphere 403, and a spherical dimple 404.

FIG. 4 also shows an example of the preferred methods of preparing the surface shape of the support. That is, the rigid true sphere 403 is caused to fall gravitationally from a position at a predetermined height above the support surface 402 and collide against the support surface 402 thereby forming the spherical dimple 404. A plurality of shperical dimples 404 each substantially of an identical radius of curvature R and of an identical width D can be formed to the support surface 402 by causing a plurality of rigid true spheres 403 substantially of an identical diameter R' to fall from identical height h simultaneously or sequentially.

FIG. 5 shows several typical embodiments of supports formed with the uneven shape composed of a plurality of spherical dimples at the surface as described above.

In the embodiments shown in FIG. 5(A), a plurality of dimples pits 604, 604, . . . substantially of an identical radius of curvature and substantially of an identical width are formed while being closely overlapped with each other thereby forming an uneven shape regularly by causing to fall a plurality of spheres 503, 503, . . . regularly substantially from an identical height to different positions at the surface 502 of the support 501. In this case, it is naturally required for forming the dimples 504, 504, . . . overlapped with each other that the spheres 503, 503, . . . are gravitationally dropped such that the times of collision of the respective spheres 503 to the support 502 are displaced from each other.

Further, in the embodiment shown in FIG. 5(B), a plurality of dimples 504, 504', . . . having two kinds of radius of curvature and two kinds of width are formed being densely overlapped with each other to the surface 503 of the support 501 thereby forming an unevenness with irregular height at the surface by dropping two kinds of spheres 503, 503', . . . of different diameters from the heights substantially identical with or different from each other.

Furthermore, in the embodiment shown in FIG. 5(C) (front elevational and cross-sectional views for the support surface), a plurality of dimples 504, 504, . . . substantially of an identical radius of curvature and plural kinds of width are formed while being overlapped with each other thereby forming an irregular unevenness by causing to fall a plurality of spheres 503, 503, . . . substantially of an identical diameter from substantially identical height irregularly to the surface 502 of the support 501.

As described above, uneven shape composed of the spherical dimples can be formed by dropping the rigid true spheres on the support surface. In this case, a plurality of spherical dimples having desired radius of curvature and width can be formed at a predetermined density on the support surface by properly selecting various conditions such as the diameter of the rigid true spheres, falling height, hardness for the rigid true sphere and the support surface or the amount of the fallen spheres. That is, the height and the pitch of the uneven shape formed on the support surface can optionally be adjusted depending on the purpose by selecting various conditions as described above thereby enabling to obtain a support having a desired uneven shape on the surface.

For making the surface of the support into an uneven shape in the light receiving member, a method of forming such a shape by the grinding work by means of a diamond cutting tool using lathe, milling cutter, etc. has been proposed, which is effective to some extent. However, the method leads to problems in that it requires to use cutting oils, remove cutting dusts inevitably resulted during cutting work and to remove the cutting oil remaining on the cut surface, which after all complicates the fabrication and reduces the working efficiency. In this invention, since the uneven surface shape of the support is formed by the spherical dimples as described above, a support having the surface with a desired uneven shape can conveniently be prepared with no problems as described above at all.

The support 101 for use in this invention may either be electroconductive or insulative. The electroconductive support can include, for example, metals such as NiCr, stainless steel, Al, Cr, Mo, Au, Nb, Ta, V, Ti, Pt, and Pb, or the alloys thereof.

The electrically insulative support can include, for example, film or sheet of synthetic resins such as polyester, polyethylene, polycarbonate, cellulose acetate, polypropylene, polyvinyl chloride, polyvinylidene chloride, polystyrene, and polyamide; glass, ceramics, and paper. It is preferred that the electrically insulative support is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_2$, $SnO_3$, ITO ($In_2O_3+SnO_2$), etc. In the case of the synthetic resin film such as polycarbonate film, the electroconductivity is provided to the surface by disposing a thin film of metal such as NiCr, Al, Ag, Pb, Zn, Ni, Au, Cr, Mo, Ir, Nb, Ta, V, Tl, and Pt by means of vacuum deposition, electron beam vapor deposition, sputtering, etc. or applying lamination with the metal to the surface. The support may be of any configuration such as cylindrical, belt-like or plate-like shape, which can be properly determined depending on the applications. For instance, in the case of using the light receiving member shown in FIG. 1 as image forming member for use in electronic photography, it is desirably configurated into an endless belt or cylindrical form in the case of continuous high speed production. The thickness of the support member is properly determined so that the light receiving member as desired can be formed. In the case where flexibility is required for the light receiving member, it can be made as thin as possible within a range capable of sufficiently providing the function as the support. However, the thickness is usually greater than 10 μm in view of the fabrication and handling or mechanical strength of the support.

Explanation will then be made to one embodiment of a device for preparing the support surface in the case of using the light receiving member according to this invention as the light receiving member for use in electronic photography while referring to FIGS. 6(A) and 6(B), but this invention is no way limited only thereto.

In the case of the support for the light receiving member for use in electronic photography, a cylindrical substrate is prepared as a drawn tube obtained by applying usual extruding work to aluminum alloy or the like other material into a boat hall tube or a mandrel tube and further applying drawing work, followed by optional heat treatment of tempering. Then, an uneven shape is formed at the surface of the support at the cylindrical substrate by using the fabrication device as shown in FIGS. 6(A) and 6(B).

The sphere used for forming the uneven shape as described above on the support surface can include, for example, various kinds of rigid spheres made of stainless steel, aluminum, steel, nickel, and brass, and like other metals, ceramics, and plastics. Among all, rigid spheres of stainless steel or steel are preferred in view of the durability and the reduced cost. The hardness of such sphere may be higher or lower than that of the support. In the case of using the spheres repeatedly, it is desired that the hardness of sphere is higher than that of the support.

FIGS. 6(A) and 6(B) are schematic cross-sectional views for the entire fabrication device, in which are shown an aluminum cylinder 601 for preparing a support and the cylinder 601 may previously be finished at the surface to an appropriate smoothness. The cylinder 601 is supported by a rotating shaft 602, driven by an appropriate drive means 603 such as a motor and made rotatable around the axial center. The rotating speed is properly determined and controlled while considering the density of the spherical dimples to be formed and the amount of rigid true spheres supplied.

A falling device 604 for gravitationally dropping rigid true spheres 605 comprises a ball feeder 606 for storing and dropping the rigid true spheres 605, a vibrator 607 for vibrating the rigid true spheres 605 so as to facilitate the dropping from feeders 609, a recovery vessel 608 for the collision against the cylinder, a ball feeder for transporting the rigid true spheres 605 recovered in the recovery vessel 608 to the feeder 606 through pipe, washers 610 for liquid-washing the rigid true spheres in the midway to the feeders 609, liquid reservoirs 611 for supplying a cleaning liquid (solvent or the like) to the washers 610 by way of nozzles of the like, recovery vessels 612 for recovering the liquid used for the washing.

The amount of the rigid true spheres gravitationally falling from the feeder 606 is properly controlled by the opening of the falling port 613, and the extent of vibration given by the vibrator 607.

Photosensitive Layer

In the light receiving member of this invention, the photosensitive layer 102 is disposed on the above-mentioned support. The photosensitive layer is composed of a-Si (Ge, Sn) (H, X) or a-Si (Ge, Sn)(O, C, N)(H, X), and preferably it contains a substance to control the conductivity.

The halogen atom (X) contained in the photosensitive layer include, specifically, fluorine, chlorine, bromine, and iodine, fluorine and chlorine being particularly preferred. The amount of the hydrogen atoms (H), the amount of the halogen atoms (X) or the sum of the amounts for the hydrogen atoms and the halogen atoms (H+X) contained in the photosensitive layer 102 is usually from 1 to 40 atomic % and, preferably, from 5 to 30 atomic %.

In the light receiving member according to this invention, the thickness of the photosensitive layer is one of the important factors for effectively attaining the purpose of this invention and a sufficient care should be taken therefor upon designing the light receiving member so as to provide the member with desired performance. The layer thickness is usually from 1 to 100 μm, preferably from 1 to 80 μm and, more preferably, from 2 to 50 μm.

Now, the purpose of incorporating germanium atoms and/or tin atoms in the photosensitive layer of the light receiving member according to this invention is chiefly for the improvement of an absorption spectrum property in the long wavelength region of the light receiving member.

That is, the light receiving member according to this invention becomes to give excellent various properties by incorporating germanium atoms and/or tin atoms into the photosensitive layer. Particularly, it becomes more sensitive to light of wavelengths broadly ranging from short wavelength to long wavelength covering visible light and it also becomes quickly responsive to light.

This effect becomes more significant when a semiconductor laser emitting ray is used as the light source.

In the photosensitive layer of the light receiving member according to this invention, it may contain germanium atoms and/or tin atoms either in the entire layer region or in the partial layer region adjacent to the support.

In the latter case, the photosensitive layer becomes to have a layer constitution that a constituent layer containing germanium atoms and/or tin atoms and another constituent layer containing neither germanium atoms nor tin atoms are laminated in this order from the side of the support.

And either in the case where germanium atoms and/or tin atoms are incorporated in the entire layer region or in the case where incorporated only in the partial layer region, germanium atoms and/or tin atoms may be distributed therein either uniformly or unevenly. (The uniform distribution means that the distribution of germanium atoms and/or tin atoms in the photosensitive layer is uniform both in the direction parallel with the surface of the support and in the thickness direction. The uneven distribution means that the distribution of germanium atoms and/or tin atoms in the photosensitive layer is uniform in the direction parallel with the surface of the support but is uneven in the thickness direction.)

And in the photosensitive layer of the light receiving member according to this invention, it is desirable that germanium atoms and/or tin atoms in the photosensitive layer be present in the side region adjacent to the support in a relatively large amount in uniform distribution state or be present more in the support side region than in the free surface side region. In these cases, when the distributing concentration of germanium atoms and/or tin atoms are extremely heightened in the side region adjacent to the support, the light of long wavelength, which can be hardly absorbed in the constituent layer or the layer region near the free surface side of the light receiving layer when a light of long wavelength such as a semiconductor emitting ray is used as the light source, can be substantially and completely absorbed in the constituent layer or in the layer region respectively adjacent to the support for the light receiving layer. And this is directed to prevent the interference caused by the light reflected from the surface of the support.

As above explained, in the photosensitive layer of the light receiving member according to this invention, germanium atoms and/or tin atoms may be distributed either uniformly in the entire layer region or the partial constituent layer region or unevenly and continuously in the direction of the layer thickness in the entire layer region or the partial constituent layer region.

In the following an explanation is made of the typical examples of the distribution of germanium atoms in the thickness direction in the photosensitive layer, with reference to FIGS. 7 through 15.

In FIGS. 7 through 15, the abscissa represents the distribution concentration C of germanium atoms and the ordinate represents the thickness of the entire photosensitive layer or the partial constituent layer adjacent to the support; and $t_B$ represents the extreme position of the photosensitive layer adjacent to the support, and $t_T$ represent the other extreme position adjacent to the surface layer which is away from the support, or the position of the interface between the constituent layer containing germanium atoms and the constituent layer not containing germanium atoms.

That is, the photosensitive layer containing germanium atoms is formed from the $t_B$ side toward $t_T$ side.

In these figures, the thickness and concentration are schematically exaggerated to help understanding.

Figure 7:
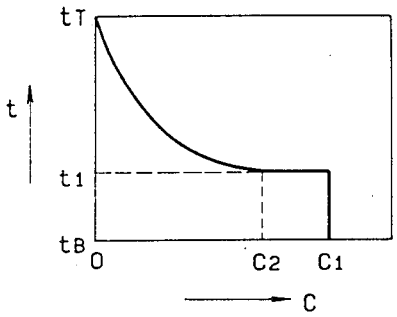
FIGS. 7 through 15 are views illustrating the thicknesswise distribution of germanium atoms or tin atoms in the photosensitive layer of the light receiving member according to this invention.

FIG. 7 shows the first typical example of the thicknesswise distribution of germanium atoms in the photosensitive layer.

In the example shown in FIG. 7, germanium atoms are distributed such that the concentration C is constant at a value $C_1$ in the range from position $t_B$ (at which the photosensitive layer containing germanium atoms is in contact with the surface of the support) to position $t_1$, and the concentration C gradually and continuously decreases from $C_2$ in the range from position $t_1$ to position $t_T$ at the interface. The concentration of germanium atoms is substantially zero at the interface position $t_T$. ("Substantially zero" means that the concentration is lower than the detectable limit.)

Figure 8:
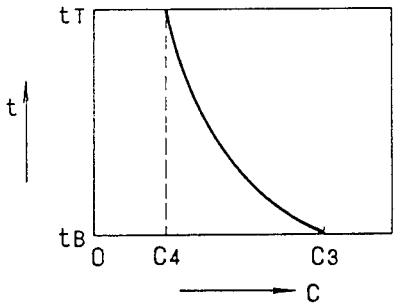

In the example shown in FIG. 8, the distribution of germanium atoms contained is such that concentration $C_3$ at position $t_B$ gradually and continuously decreases to concentration $C_4$ at position $t_T$.

Figure 9:
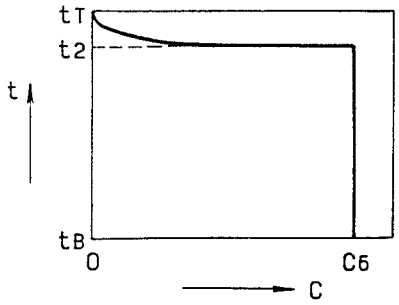

In the example shown in FIG. 9, the distribution of germanium atoms is such that concentration $C_5$ is constant in the range from position $t_B$ and position $t_2$ and it gradually and continuously decreases in the range from position $t_2$ and position $t_T$. The concentration at position $t_T$ is substantially zero.

Figure 10:
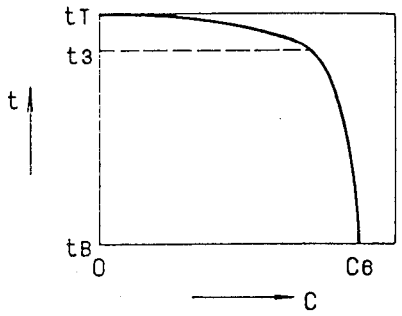

In the example shown in FIG. 10, the distribution of germanium atoms is such that concentration $C_6$ gradually and continuously decreases in the range from position $t_B$ and position $t_3$, and it sharply and continuously decreases in the range from position $t_3$ to position $t_T$. The concentration at position $t_T$ is substantially zero.

Figure 11:
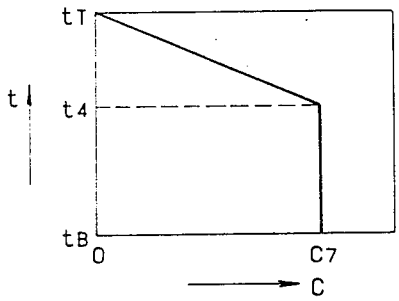

In the example shown in FIG. 11, the distribution of germanium atoms C is such that concentration $C_7$ is constant in the range from position $t_B$ and position $t_4$ and it linearly decreases in the range from position $t_4$ to position $t_T$. The concentration at position $t_T$ is zero.

Figure 12:
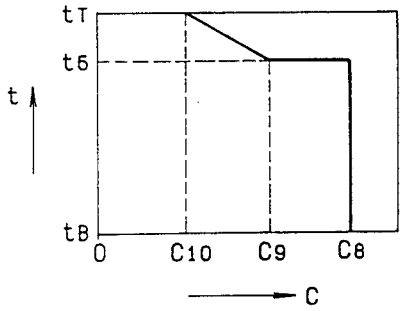

In the example shown in FIG. 12, the distribution of germanium atoms is such that concentration $C_8$ is constant in the range from position $t_B$ and position $t_5$ and concentration $C_9$ linearly decreases to concentration $C_{10}$ in range from position $t_5$ to position $t_T$.

Figure 13:
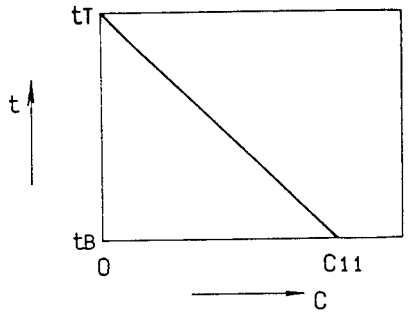

In the example shown in FIG. 13, the distribution of germanium atoms is such that concentration linearly decreases to zero in the range from position $t_B$ to position $t_T$.

Figure 14:
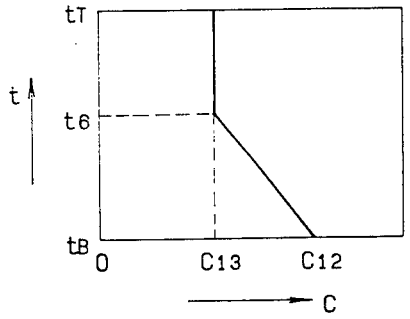

In the example shown in FIG. 14, the distribution of germanium atoms is such that concentration $C_{12}$ linearly decreases to $C_{13}$ in the range from position $t_B$ to position $t_6$ and concentration $C_{13}$ remains constant in the range from position $t_6$ to position $t_T$.

Figure 15:
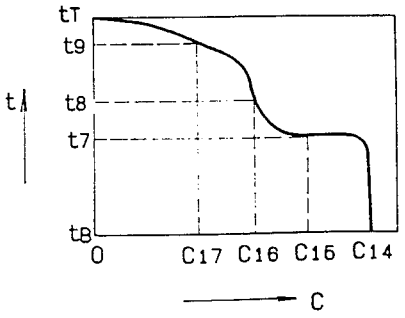

In the example shown in FIG. 15, the distribution of germanium atoms is such that concentration $C_{14}$ at position $t_B$ slowly decreases and then sharply decreases to concentration $C_{15}$ in the range from position $t_B$ to position $t_7$.

In the range from position $t_7$ to position $t_8$, the concentration sharply decreases at first and slowly decreases to $C_{16}$ at position $t_8$. The concentration slowly decreases to $C_{17}$ between position $t_8$ and position $t_9$. Concentration $C_{17}$ further decreases to substantially zero between position $t_9$ and position $t_T$. The concentration decreases as shown by the curve.

Several examples of the thicknesswise distribution of germanium atoms and/or tin atoms in the layer 102' have been illustrated in FIGS. 7 through 15. In the light receiving member of this invention, the concentration of germanium atoms and/or tin atoms in the photosensitive layer should preferably be high at the position adjacent to the support and considerably low at the position adjacent to the interface $t_T$.

In other words, it is desirable that the photosensitive layer constituting the light receiving member of this invention have a region adjacent to the support in which germanium atoms and/or tin atoms are locally contained at a comparatively high concentration.

Such a local region in the light receiving member of this invention should preferably be formed within 5 $\mu$m from the interface $t_B$.

The local region may occupy entirely or partly the thickness of 5 $\mu$m from the interface position $t_B$.

Whether the local region should occupy entirely or partly the layer depends on the performance required for the light receiving layer to be formed.

The thicknesswise distribution of germanium atoms and/or tin atoms contained in the local region should be such that the maximum concentration $C_{max}$ of germanium atoms and/or tin atoms is greater than 1000 atomic ppm, preferably greater than 5000 atomic ppm, and more preferably greater than $1\times10^4$ atomic ppm based on the amount of silicon atoms.

In other words, in the light receiving member of this invention, the photosensitive layer which contains germanium atoms and/or tin atoms should preferably be formed such that the maximum concentration $C_{max}$ of their distribution exists within 5 $\mu$m of the thickness from $t_B$ (or from the support side).

In the light receiving member of this invention, the amount of germanium atoms and/or tin atoms in the photosensitive layer should be properly determined so that the object of the invention is effectively achieved. It is usually 1 to $6\times10^5$ atomic ppm, preferably 10 to $3\times10^5$ atomic ppm, and more preferably $1\times10^2$ to $2\times10^5$ atomic ppm.

The photosensitive layer of the light receiving member of this invention may be incorporated with at least one kind selected from oxygen atoms, carbon atoms, nitrogen atoms. This is effective in increasing the photosensitivity and dark resistance of the light receiving member and also in improving adhesion between the support and the light receiving layer.

In the case of incorporating at least one kind selected from oxygen atoms, carbon atoms, and nitrogen atoms into the photosensitive layer of the light receiving member according to this invention, it is performed at a uniform distribution or uneven distribution in the direction of the layer thickness depending on the purpose or the expected effects as described above, and accordingly, the content is varied depending on them.

That is, in the case of increasing the photosensitivity, the dark resistance of the light receiving member, they are contained at a uniform distribution over the entire layer region of the photosensitive layer. In this case, the amount of at least one kind selected from carbon atoms, oxygen atoms, and nitrogen atoms contained in the photosensitive layer may be relatively small.

In the case of improving the adhesion between the support and the photosensitive layer, at least one kind selected from carbon atoms, oxygen atoms, and nitrogen atoms is contained uniformly in the layer constituting the photosensitive layer adjacent to the support, or at least one kind selected from carbon atoms, oxygen atoms, and nitrogen atoms is contained such that the distribution concentration is higher at the end of the photosensitive layer on the side of the support. In this case, the amount of at least one kind selected from oxygen atoms, carbon atoms, and nitrogen atoms is comparatively large in order to improve the adhesion to the support.

The amount of at least one kind selected from oxygen atoms, carbon atoms, and nitrogen atoms contained in the photosensitive layer of the light receiving member according to this invention is also determined while considering the organic relationship such as the performance at the interface in contact with the support, in addition to the performance required for the light receiving layer as described above and it is usually form 0.001 to 50 atomic %, preferably, from 0.002 to 40 atomic %, and, most suitably, from 0.003 to 30 atomic %.

By the way, in the case of incorporating the element in the entire layer region of the photosensitive layer or the proportion of the layer thickness of the layer region incorporated with the element is greater in the layer thickness of the light receiving layer, the upper limit for the content is made smaller. That is, if the thickness of the layer region incorporated with the element is 2/5 of the thickness for the photosensitive layer, the content is usually less than 30 atomic %, preferably, less than 20 atomic % and, more suitably, less than 10 atomic %.

Some typical examples in which a relatively large amount of at least one kind selected from oxygen atoms, carbon atoms, and nitrogen atoms is contained in the photosensitive layer according to this invention on the side of the support, then the amount is gradually decreased from the end on the side of the support to the end on the side of the free surface and decreased further to a relatively small amount or substantially zero near the end of the photosensitive layer on the side of the free surface will be hereunder explained with reference to FIGS. 16 through 24. However, the scope of this invention is not limited to them.

The content of at least one of the elements selected from oxygen atoms (O), carbon atoms (C) and nitrogen atoms (N) is hereinafter referred to as "atoms (O, C, N)".

In FIGS. 16 through 24, the abscissa represents the distribution concentration C of the atoms (O, C, N) and the ordinate represents the thickness of the photosensitive layer; and $t_B$ represents the interface position between the support and the photosensitive layer and $t_T$ represents the interface position between the free surface and the photosensitive layer.

Figure 16:
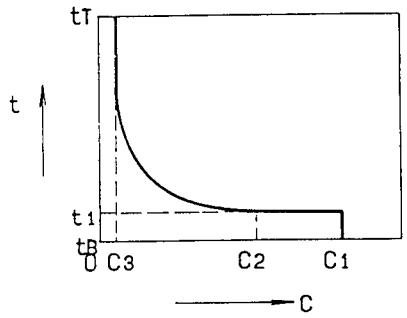
FIGS. 16 through 24 are views illustrating the thicknesswise distribution of oxygen atoms, carbon atoms, or nitrogen atoms, or the thicknesswise distirubution of the group III atoms or the group V atoms in the photosensitive layer of the light receiving member according to this invention, the ordinate representing the thickness of the photosensitive layer and the abscissa representing the distribution concentration of respective atoms.

FIG. 16 shows the first typical example of the thicknesswise distribution of the atoms (O, C, N) in the photosensitive layer. In this example, the atoms (O, C, N) are distributed in the way that the concentration C remains constant at a value $C_1$ in the range from position $t_B$ (at which the photosensitive layer comes into contact with the support) to position $t_1$, and the concentration C gradually and continuously decreases from $C_2$ in the range from position $t_1$ to position $t_T$, where the concentration of the group III atoms or group V atoms is $C_3$.

Figure 17:
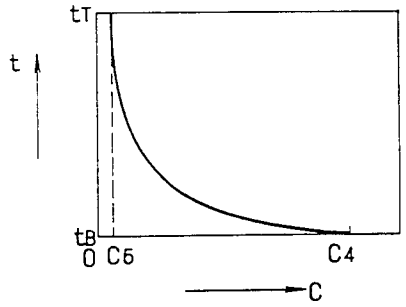

In the example shown in FIG. 17, the distribution concentration C of the atoms (O, C, N) contained in the photosensitive layer is such that concentration $C_4$ at position $t_B$ continuously decreases to concentration $C_5$ at position $t_T$.

Figure 18:
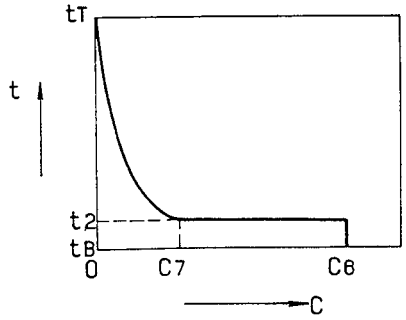

In the example shown in FIG. 18, the distribution concentration C of the atoms (O, C, N) is such that concentration $C_6$ remains constant in the range from position $t_B$ and position $t_2$ and it gradually and continuously decreases in the range from position $t_2$ and position $t_T$. The concentration at position $t_T$ is substantially zero.

Figure 19:
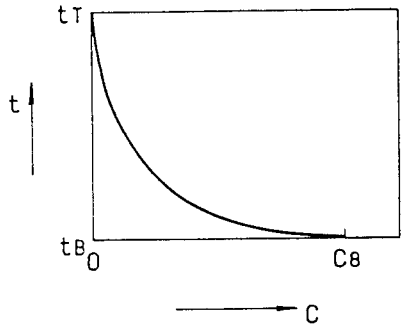

In the example shown in FIG. 19, the distribution concentration C of the atoms (O, C, N) is such that concentration $C_8$ gradually and continuously decreases in the range from position $t_B$ and position $t_T$, at which it is substantially zero.

Figure 20:
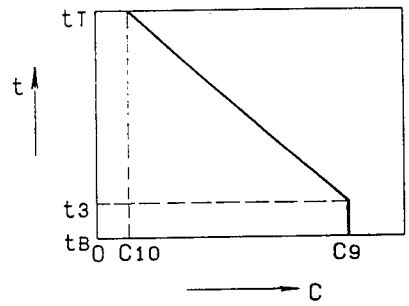

In the example shown in FIG. 20, the distribution concentration C of the atoms (O, C, N) is such that concentration $C_9$ remains constant in the range from position $t_B$ to position $t_3$, and concentration $C_8$ linearly decreases to concentration $C_{10}$ in the range from position $t_3$ to position $t_T$.

Figure 21:
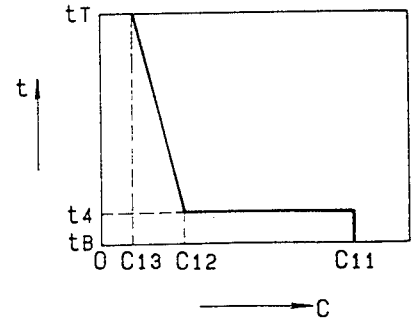

In the example shown in FIG. 21, the distribution concentration C of the atoms (O, C, N) is such that concentration $C_{11}$ remains constant in the range from position $t_B$ and position $t_4$ and it linearly decreases to $C_{14}$ in the range from position $t_4$ to position $t_T$.

Figure 22:
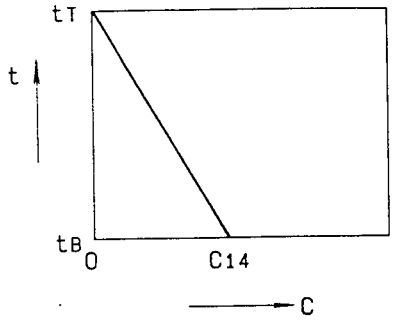

In the example shown in FIG. 22, the distribution concentration C of the atoms (O, C, N) is such that concentration $C_{14}$ linearly decreases in the range from position $t_B$ to position $t_T$, at which the concentration is substantially zero.

Figure 23:
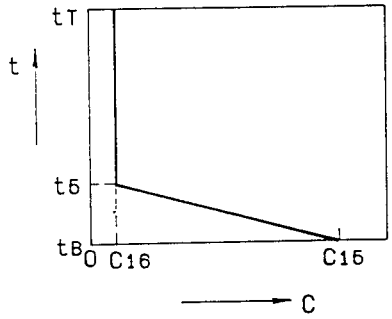

In the example shown in FIG. 23, the distribution concentration C of the atoms (O, C, N) is such that concentration $C_{15}$ linearly decreases to concentration $C_{16}$ in the range from position $t_B$ to position $t_5$ and concentration $C_{16}$ remains constant in the range from position $t_5$ to position $t_T$.

Figure 24:
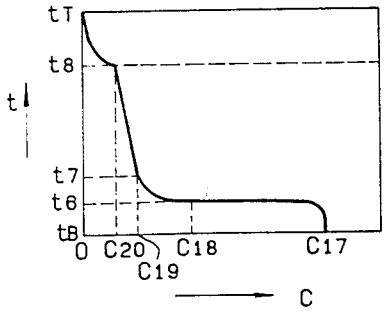

Finally, in the example shown in FIG. 24, the distribution concentration C of the atoms (O, C, N) is such that concentration $C_{17}$ at position $t_B$ slowly decreases and then sharply decreases to concentration $C_{18}$ in the range from position $t_B$ to position $t_6$. In the range from position $t_6$ to position $t_7$, the concentration sharply decreases at first and slowly decreases to $C_{19}$ at position $t_7$. The concentration slowly decreases between position $t_7$ and position $t_8$, at which the concentration is $C_{20}$. Concentration $C_{20}$ slowly decreases to substantially zero between position $t_8$ and position $t_T$.

As shown in the embodiments of FIGS. 16 through 24, in the case where the distribution concentration C of the atoms (0, C, N) is higher at the portion of the photosensitive layer near the side of the support, while the distribution concentration C is considerably lower or substantially reduced to zero in the portion of the photosensitive layer is the vicinity of the free surface, the improvement in the adhesion of the photosensitive layer with the support can be more effectively attained by disposing a localized region where the distribution concentration of the atoms (O, C, N) is relatively higher at the portion near the side of the support, preferably, by disposing the localized region at a position within 5 μm from the interface position adjacent to the support surface.

The localized region may be disposed partially or entirely at the end of the light receiving layer to be contained with the atoms (O, C, N) on the side of the support, which may be properly determined in accordance with the performance required for the light receiving layer to be formed.

It is desired that the amount of the atoms (O, C, N) contained in the localized region is such that the maximum value of the distribution concentration C of the atoms (O, C, N) is greater than 500 atomic ppm, preferably, greater than 800 atomic ppm, most suitably greater than 1000 atomic ppm in the distribution.

In the photosensitive layer of the light receiving member according to this invention, a substance for controlling the electroconductivity may be contained to the light receiving layer in a uniformly or unevenly distributed state to the entire or partial layer region.

As the substance for controlling the conductivity, so-called impurities in the field of the semiconductor can be mentioned and those usable herein can include atoms belonging to the group III of the periodic table that provide p-type conductivity (hereinafter simply referred to as "group III atoms") or atoms belonging to the group V of the periodic table that provide n-type conductivity (hereinafter simply referred to as "group V atoms"). Specifically, the group III atoms can include B (boron), Al (aluminum), Ga (gallium), In (indium), and Tl (thallium), B and Ga being particularly preferred. The group V atoms can include, for example, P (phosphorus), As (arsenic), Sb (antimony), and Bi (bismuth), P and Sb being particularly preferred.

In the case of incorporating the group III or group V atoms as the substance for controlling the conductivity into the photosensitive layer of the light receiving member according to this invention, they are contained in the entire layer region or partial layer region depending on the purpose or the expected effects as described below and the content is also varied.

That is, if the main purpose resides in the control for the conduction type and/or conductivity of the photosensitive layer, the substance is contained in the entire layer region of the photosensitive layer, in which the content of group III or group V atoms may be relatively small and it is usually from $1\times10^{-3}$ to $1\times10^{3}$ atomic ppm, preferably from $5\times10^{-2}$ to $5\times10^{2}$ atomic ppm, and most suitably, from $1\times10^{-1}$ to $5\times10^{2}$ atomic ppm.

In the case of incorporating the group III or group V atoms in a uniformly distributed state to a portion of the layer region in contact with the support, or the atoms are contained such that the distribution density of the group III or group V atoms in the direction of the layer thickness is higher on the side adjacent to the support, the constituting layer containing such group III or group V atoms or the layer region containing the group III or group V atoms at high concentration functions as a charge injection inhibition layer. That is, in the case of incorporating the group III atoms, movement of electrons injected from the side of the support into the photosensitive layer can effectively be inhibited upon applying the charging treatment of at positive polarity at the free surface of the photosensitive layer. While on the other hand, in the case of incorporating the group III atoms, movement of positive holes injected from the side of the support into the photosensitive layer can effectively be inhibited upon applying the charging treatment at negative polarity at the free surface of the layer. The content in this case is relatively great. Specifically, it is generally from 30 to $5\times104$ atomic ppm, preferably from 50 to $1\times10^{4}$ atomic ppm, and most suitably from $1\times10^{2}$ to $5\times10^{3}$ atomic ppm. Then, for the charge injection inhibition layer to produce the intended effect, the thickness (T) of the photosensitive layer and the thickness (t) of the layer or layer region containing the group III or group V atoms adjacent to the support should be determined such that the relation $t/T\leqq0.4$ is established. More preferably, the value for the relationship is less than 0.35 and, most suitably, less than 0.3. Further, the thickness (t) of the layer or layer region is generally $3\times10^{-3}$ to 10 μm, preferably $4\times10^{-3}$ to 8 μm, and, most suitably, $5\times10^{-3}$ to 5 μm.

Further, typical embodiments in which the group III or group V atoms incorporated into the light receiving layer is so distributed that the amount therefor is relatively great on the side of the support, decreased from the support toward the free surface of the light receiving layer, and is relatively smaller or substantially equal to zero near the end on the side of the free surface, may be explained on the analogy of the examples in which the photosensitive layer contains the atoms (O, C, N) as shown in FIGS. 16 to 24. However, this invention is no way limited only to these embodiments.

As shown in the embodiments of FIGS. 16 through 24, in the case where the distribution density C of the group III or group V atoms is higher at the portion of the light receiving layer near the side of the support, while the distribution density C is considerably lower or substantially reduced to zero in the interface between the photosensitive layer and the surface layer, the foregoing effect that the layer region where the group III or group V atoms are distributed at a higher density can form the charge injection inhibition layer as described above more effectively, by disposing a locallized region where the distribution density of the group III or group V atoms is relatively higher at the portion near the side of the support, preferably, by disposing the locallized region at a position within 5μ from the interface position in adjacent with the support surface.

While the individual effects have been described above for the distribution state of the group III or group V atoms, the distribution state of the group III or group V atoms and the amount of the group III or group V atoms are, of course, combined properly as required for obtaining the light receiving member having performances capable of attaining a desired purpose. For instance, in the case of disposing the charge injection inhibition layer at the end of the photosensitive layer on the side of the support, a substance for controlling the conductivity of a polarity different from that of the. substance for controlling the conductivity contained in the charge injection inhibition layer may be contained in the photosensitive layer other than the charge injection inhibition layer, or a substance for controlling the conductivity of the same polarity may be contained by an amount substantially smaller than that contained in the charge inhibition layer.

Further, in the light receiving member according to this invention, a so-called barrier layer composed of electrically insulating material may be disposed instead of the charge injection inhibition layer as the constituent layer disposed at the end on the side of the support, or both of the barrier layer and the charge injection inhibition layer may be disposed as the constituent layer. The material for constituting the barrier layer can include, for example, those inorganic electrically insulating materials such as $Al_2O_3$, $SiO_2$ and $Si_3N_4$ or organic electrically insulating material such as polycarbonate.

Surface Layer

The surface layer 103 of the light receiving member according to this invention is disposed on the foregoing photosensitive layer 102 and has the free surface 104.

The surface layer 103 comprises a-Si containing at least one of the elements selected from oxygen atoms (O), carbon atoms (C) and nitrogen (N) and, preferably, at least one of the elements of hydrogen atoms (H) and halogen atoms (X) (hereinafter referred to as "a-Si (O, C, N)(H, X)"), and it provides a function of reducing the reflection of the incident light at the free surface 104 of the light receiving member and increasing the transmission rate, as well as a function of improving various properties such as moisture proofness, property for continuous repeating use, electrical voltage withstanding property, circumstantial-resistant property and durability of the light receiving member.

In this case, it is necessary to constitute such that the optical band gap Eopt possessed by the surface layer and the optical band gap Eopt possessed by the photosensitive layer 102 directly disposed with the surface layer 103 are matched at the interface between the surface layer 103 and the photosensitive layer 102, or such optical band gaps are matched to such an extent as capable of substantially preventing the reflection of the incident light at the interface between the surface layer 103 and the photosensitive layer 102.

Further, in addition to the conditions as described above, it is desirable to constitute such that the optical band gap Eopt possessed by the surface layer is sufficiently larger at the end of the surface layer 103 on the side of the free surface for ensuring a sufficient amount of the incident light reaching the photosensitive layer 102 disposed below the surface layer. Then, in the case of adapting the optical band gaps at the interface between the surface layer 103 and the photosensitive layer 102, as well as making the optical band gap Eopt sufficiently larger at the end of the surface layer on the side of the free surface, the optical band gap possessed by the surface layer is continuously varied in the direction of the thickness of the surface layer.

The value of the optical band gap Eopt of the surface layer in the direction of the layer thickness is controlled by controlling, the content of at least one of the elements selected from the oxygen atoms (O), carbon atoms (C) and nitrogen atoms (N) as the atoms for adjusting the optical band gaps contained in the surface layer is controlled.

Specifically, the content of at least one of the elements selected from oxygen atoms (O), carbon atoms (C) and nitrogen atoms (N) (hereinafter referred to as "atoms (O, C, N)") is adjusted nearly or equal to zero at the end of the photosensitive layer in adjacent with the surface layer.

Then, the amount of the atoms (O, C, N) is continuously increased from the end of the surface layer on the side of the photosensitive layer to the end on the side of the free surface and a sufficient amount of atoms (O, C, N) to prevent the reflection of the incident light at the free surface is contained near the end on the side of the free surface. Hereinafter, several typical examples for the distributed state of the atoms (O, C, N) in the surface layer are explained referring to FIGS. 25 through 27, but this invention is no way limited only to these embodiments.

Figure 25:
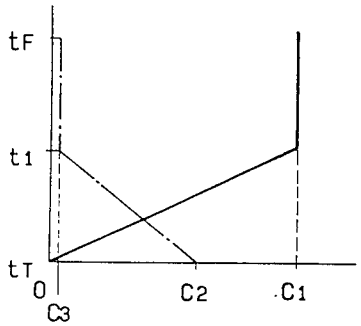
FIGS. 25 through 27 are views illustrationg the thicknesswise distribution of silicon atoms and of oxygen atoms, carbon atoms or nitrogen atoms in the surface layer of the light receiving member according to this invention, the ordinate representing the thickness of the surface layer and the abscissa representing the distribution concentration of respective atoms.
Figure 26:
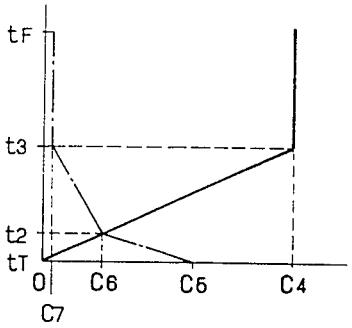
Figure 27:
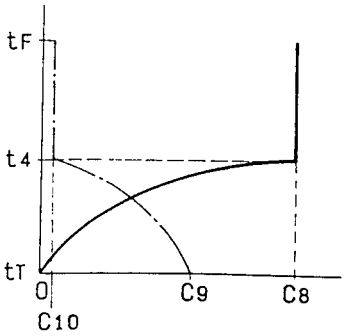

In FIGS. 25 through 27, the abscissa represents the distribution density C of the atoms (O, C, N) and silicon atoms and the ordinate represents the thickness t of the surface layer, in which $t_T$ is the position for the interface between the photosensitive layer and the surface layer, $t_F$ is a position for the free surface, the solid line represents the variation in the distribution density of the atoms (O, C, N) and the broken line shows the variation in the distribution density of the silicon atoms (Si).

FIG. 25 shows a first typical embodiment for the distribution state of the atoms (O, C, N) and the silicon atoms (Si) contained in the surface layer in the direction of the layer thickness. In this embodiment, the distribution density C of the atoms (O, C, N) is increased till the density is increased from zero to a density $C_1$ from the interface position $t_T$ to the position $t_1$ linearly. While on the other hand, the distribution density of the silicon atoms is decreased linearly from a density $C_2$ to a density $C_3$ from the position $t_1$ to the position $t_F$. The distribution density C for the atoms (O, C, N) and the silicon atoms are kept at constant density $C_1$ and density $C_3$ respectively.

In the embodiment shown in FIG. 26, the distribution density C of the atoms (O, C, N) is increased linearly from the density zero to a density $C_4$ from the interface position $t_T$ to the position $t_3$, while it is kept at a constant density $C_4$ from the position $t_3$ to the position $t_F$. While on the other hand, the distribution density C of the silicon atoms is decreased linearly from a density $C_5$ to a density $C_6$ from the position $t_T$ to the position $t_2$, decreased linearly from the density $C_6$ to a density $C_7$ from the position $t_2$ to the position $t_3$, and kept at the constant density $C_7$ from the position $t_3$ to the position $t_F$. In the case where the density of the silicon atoms is high at the initial stage of forming the surface layer, the film forming rate is increased. In this case, the film forming rate can be compensated by decreasing the distribution density of the silicon atoms in the two steps as in this embodiment.

In the embodiment shown in FIG. 27, the distribution density of the atoms (O, C, N) is continuously increased from zero to a density $C_8$ from the position $t_T$ to the position $t_4$, while the distribution density C of the silicon atoms (Si) is continuously decreased from a density $C_9$ to a density $C_{10}$. The distribution density of the atoms (O, C, N) and the distribution density of the silicon atoms (Si) are kept at a constant density $C_8$ and a constant density $C_{10}$ respectively from the position $t_4$ to the position $t_F$. In the case of continuously increasing the distribution density of the atoms (O, C, N) gradually as in this embodiment, the variation coefficient of the reflective rate in the direction of the layer thickness of the surface layer can be made substantially constant.

As shown in FIGS. 25 through 27, in the surface layer of the light receiving member according to this invention, it is desired to dispose a layer region in which the distribution density of the atoms (O, C, N) is made substantially zero at the end of the surface layer on the side of the photosensitive layer, increased continuously toward the free surface and made relatively high at the end of the surface layer on the side of the free surface. Then, the thickness of the layer region in this case is usually made greater than 0.1 $\mu$m for providing a function as the reflection preventive layer and a function as the protecting layer.

It is desired that at least one of the hydrogen atoms and the halogen atoms are contained also in the surface layer, in which the amount of the hydrogen atoms (H), the amount of the halogen atoms (X) or the sum of the hydrogen atoms and the halogen atoms (H+X) are usually from 1 to 40 atm %, preferably, from 5 to 30 atm % and, most suitably, from 5 to 25 atm %.

Further, in this invention, the thickness of the surface layer is also one of the most important factors for effectively attaining the purpose of the invention, which is properly determined depending on the desired purposes. It is required that the layer thickness is determined in view of the relative and organic relationship in accordance with the amount of the oxygen atoms, carbon atoms, nitrogen atoms, halogen atoms and hydrogen atoms contained in the surface layer or the properties required for the surface layer. Further, it should be determined also from the economical point of view such as productivity and mass productivity. In view of the above, the thickness of the surface layer is usually from $3\times10^{-3}$ to $30\mu$, preferably, from $4\times10^{-3}$ to $20\mu$ and, particularly preferably, from $5\times10^{-3}$ to $10\mu$.

By adopting the layer structure of the light receiving member according to this invention as described above, all of the various problems in the light receiving members comprising the light receiving layer constituted with amorphous silicon as described above can be overcome. Particularly, in the case of using the coherent laser beams as a light source, it is possible to remarkably prevent the occurrence of the interference fringe pattern upon forming images due to the interference phenomenon thereby enabling to obtain reproduced image at high quality.

Further, since the light receiving member according to this invention has a high photosensitivity in the entire visible ray region and, further, since it is excellent in the photosensitive property on the side of the longer wavelength, it is suitable for the matching property, particularly, with a semiconductor laser, exhibits a rapid optical response and shows more excellent electrical, optical and electro-conductive nature, electrical voltage withstand property and resistance to working circumstances.

Particularly, in the case of applying the light receiving member to the electrophotography, it gives no undesired effects at all of the residual potential to the image formation, stable electrical properties high sensitivity and high S/N ratio, excellent light fastness and property for repeating use, high image density and clear half tone and can provide high quality image with high resolution power repeatingly.

The method of forming the light receiving layer according to this invention will now be explained.

The amorphous material constituting the light receiving layer in this invention is prepared by vacuum deposition technique utilizing the discharging phenomena such as glow discharging, sputtering, and ion plating process. These production processes are properly used selectively depending on the factors such as the manufacturing conditions, the installation cost required, production scale and properties required for the light receiving members to be prepared. The glow discharging process or sputtering process is suitable since the control for the condition upon preparing the light receiving members having desired properties are relatively easy and carbon atoms and hydrogen atoms can be introduced easily together with silicon atoms. The glow discharging process and the sputtering process may be used together in one identical system.

Basically, when a layer constituted with a-Si (H, X) is formed, for example, by the glow discharging process, gaseous starting material for supplying Si capable of supplying silicon atoms (Si) are introduced together with gaseous starting material for introducing hydrogen atoms (H) and/or halogen atoms (X) into a deposition chamber the inside pressure of which can be reduced, glow discharge is generated in the deposition chamber, and a layer composed of a-Si (H, X) is formed on the surface of a predetermined support disposed previously at a predetermined position in the chamber.

The gaseous starting material for supplying Si can include gaseous or gasifiable silicon hydrides (silanes) such as $SiH_4$, $Si_2H_6$, $Si_3H_8$, $Si_4H_{10}$, etc., $SiH_4$ and $Si_2H_6$ being particularly preferred in view of the easy layer forming work and the good efficiency for the supply of Si.

Further, various halogen compounds can be mentioned as the gaseous starting material for introducing the halogen atoms and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICL, IBr, etc.; and silicon halides such as $SiF_4$, $Si_2H_6$, $SiCL_4$, and $SiBr_4$. The use of the gaseous or gasifiable silicon halide as described above is particularly advantageous since the layer constituted with halogen atom-containing a-Si can be formed with no additional use of the gaseous starting material for supplying Si.

The gaseous starting material usable for supplying hydrogen atoms can include those gaseous or gasifiable materials, for example, hydrogen gas, halides such as HF, HCL , HBr, and HI, silicon hydrides such as $SiH_4$, $Si_2H_6$, $Si_3H_8$, and $Si_4O_{10}$, or halogen-substituted silicon hydrides such as $SiH_2F_2$, $SiH_2I_2$, $SiH_2CL_2$, $SiHCl_3$, $SiH_2Br_2$, and $SiHBr_3$. The use of these gaseous starting material is advantageous since the content of the hydrogen atoms (H), which are extremely effective in view of the control for the electrical or photo-electronic properties, can be controlled with ease. Then, the use of the hydrogen halide or the halogen-substituted silicon hydride as described above is particularly advantageous since the hydrogen atoms (H) are also introduced together with the introduction of the halogen atoms.

In the case of forming a layer comprising a-Si (H, X) by means of the reactive sputtering process or ion plating process, for example, by the sputtering process, the halogen atoms are introduced by introducing gaseous halogen compounds or halogen atom-containing silicon compounds into a deposition chamber thereby forming a plasma atmosphere with the gas.

Further, in the case of introducing the hydrogen atoms, the gaseous starting material for introducing the hydrogen atoms, for example, $H_2$ or gaseous silanes are described above are introduced into the sputtering deposition chamber thereby forming a plasma atmosphere with the gas.

For instance, in the case of the reactive sputtering process, a layer comprising a-Si (H, X) is formed on the support by using an Si target and by introducing a halogen atom-introducing gas and $H_2$ gas together with an inert gas such as He or Ar as required into a deposition chamber thereby forming a plasma atmosphere and then sputtering the Si target.

To form the layer of a-SiGe (H, X) by the glow discharge process, a feed gas to liberate silicon atoms (Si), a feed gas to liberate germanium atoms (Ge), and a feed gas to liberate hydrogen atoms (H) and/or halogen atoms (X) are introduced under appropriate gaseous pressure condition into an evacuatable deposition chamber, in which the glow discharge is generated so that a layer of a-SiGe (H, X) is formed on the properly positioned support in the chamber.

The feed gases to supply silicon atoms, halogen atoms, and hydrogen atoms are the same as those used to form the layer of a-Si (H, X) mentioned above.

The feed gas to liberate Ge includes gaseous or gasifiable germanium halides such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, and $Ge_9H_{20}$, with $GeH_4$, $Ge_2H_6$ and $Ge_3H_8$, being preferable on account of their ease of handling and the effective liberation of germanium atoms.

To form the layer of a-SiGe (H, X) by the sputtering process, two targets (a slicon target and a germanium target) or a single target composed of silicon and germanium is subjected to sputtering in a desired gas atmosphere.

To form the layer of a-SiGe (H, X) by the ion-plating process, the vapors of silicon and germanium are allowed to pass through a desired gas plasma atmosphere. The silicon vapor is produced by heating polycrystal silicon or single crystal silicon held in a boat, and the germanium vapor is produced by heating polycrystal germanium or single crystal germanium held in a boat. The heating is accomplished by resistance heating or electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms, a feed gas to liberate hydrogen is introduced into the deposition chamber in which a plasma atmosphere of the gas is produced. The feed gas may be gaseous hydrogen, silanes, and/or germanium hydrides. The feed gas to liberate halogen atoms includes the above-mentioned halogen-containing silicon compounds. Other examples of the feed gas include hydrogen halides such as HF, HCL , HBr, and HI; halogen-substituted silanes such as $SiH_2F_2$, $SiH_2I_2$, $SiH_2CL_2$, $SiHCL_3$, $SiH_2Br_2$, and $SiHBr_3$; germanium hydride halide such as $GeHF_3$, $GeH_2F_2$, $GeH_3F$, $GeHCL_3$, $GeH_2CL_2$, $GeH_3CL$, $GeHBr_3$, $GeH_2Br_2$, $GeH_3Br$, $GeHI_3$, $GeH_2I_2$, and $GeH_3I$; and germanium halides such as $GeF_4$, $GeCL_4$, $GeBr_4$, $GeI_4$, $GeF_2$, $GeCl_2$, $GeBr_2$, and $GeI_2$. They are in the gaseous form or gasifiable substances.

To form the light receiving layer composed of amorphous silicon containing tin atoms (referred to as a-SiSn (H, X) hereinafter) by the glow-discharge process, sputtering process, or ion-plating process, a starting material (feed gas) to release tin atoms (Sn) is used in place of the starting material to release germanium atoms which is used to form the layer composed of a-SiGe (H, X) as mentioned above. The process is properly controlled so that the layer contains a desired amount of tin atoms.

Examples of the feed gas to release tin atoms (Sn) include tin hydride ($SnH_4$) and tin halides (such as $SnF_2$, $SnF_4$, $SnCL_2$, $SnCL_4$, $SnBr_2$, $SnBr_4$, $SnI_2$, and $SnI_4$) which are in the gaseous form or gasifiable. Tin halides are preferable because they form on the substrate a layer of a-Si containing halogen atoms. Axong tin halides, $SnCL_4$ is particularly preferable because of its ease of handling and its efficient tin supply.

In the case where solid $SnCL_4$ is used as a starting material to supply tin atoms (Sn), it should preferably be gasified by blowing (bubbling) an inert gas (e.g., Ar and He) into it wbile heating. The gas thus generated is introduced, at a desired pressure, into the evacuated deposition chamber.

The layer may be formed from an amorphous material (a-Si (H, X) or a-Si (Ge, Sn)(H, X)) which further contains the group III atoms or group V atoms, nitrogen atoms, oxygen atoms, or carbon atoms, by the glow-discharge process,sputtering process, or ion-plating process. In this case, the above-mentioned starting material for a-Si (H, X) or a-Si (Ge, Sn) (H, X) is used in combination with the starting materials to introduce the group III atoms or group V atoms, nitrogen atoms, oxygen atoms, or carbon atoms. The supply of the starting materials should be properly controlled so that the layer contains a desired amount of the necessary atoms.

If, for example, the layer is to be formed by the glow-discharge process from a-Si (H, X) containing atoms (O, C, N) or from a-Si (Ge, Sn)(H, X) containing atoms (O, C, N), the starting material to form the layer of a-Si (H, X) or a-Si (Ge, Sn)(H, X) should be combined with the starting material used to introduce atoms (O, C, N). The supply of these starting materials should be properly controlled so that the layer contains a desired amount of the necessary atoms.

The starting material to introduce the atoms (O, C, N) may be any gaseous substance or gasifiable substance composed of any of oxygen, carbon, and nitrogen. Examples of the starting materials used to introduce oxygen atoms (O) include oxygen ($O_2$), ozone ($O_3$), nitrogen dioxide ($NO_2$), nitrous oxide ($N_2O$), dinitrogen trioxide ($N_2O_3$), dinitrogen tetroxide ($N_2O_4$), dinitrogen pentoxide ($N_2O_5$), and nitrogen trioxide ($NO_3$) Additional examples include lower siloxanes such as disiloxane ($H_3SiOSiH_3$) and trisiloxane ($H_3SiOSiH_2OSiH_3$) which are composed of silicon atoms (Si), oxygen atoms (O), and hydrogen atoms (H). Examples of the starting materials used to introduce carbon atoms include saturated hydrocarbons having 1 to 5 carbon atoms such as methane ($CH_4$), ethane ($C_2H_6$), propane ($C_3H_8$), n-butane (n-$C_4$ $H_{10}$), and pentane ($C_5H_{12}$); ethylenic hydrocarbons having 2 to 5 carbon atoms such as ethylene ($C_2H_4$), propylene ($C_3H_6$), butene-1 ($C_4H_8$), butene-2 ($C_4H_8$), isobutylene ($C_4H_8$), and pentene ($C_5H_{10}$); and acetylenic hydrocarbons having 2 to 4 carbon atoms such as acetylene. ($C_2H_2$), methyl acetylene ($C_3H_4$), and butine ($C_4H_6$). Examples of the starting materials used to introduce nitrogen atoms include nitrogen ($N_2$), ammonia ($NH_3$), hydrazine ($H_2NNH_2$), hydrogen azide ($HN_3$), ammonium azide ($NH_4N_3$), nitrogen trifluoride ($F_3N$), and nitrogen tetrafluoride ($F_4N$).

For instance, in the case of forming a layer or layer region constituted with a-Si (H, X) or a-Si (Ge, Sn)(H, X) containing the group III atoms or group V atoms by using the glow discharging, sputtering, or ion-plating process, the starting material for introducing the group III or group V atoms are used together with the starting material for forming a-Si (H, X) or a-Si (Ge, Sn)(H, X) upon forming the layer constituted with a-Si (H, X) or a-Si (Ge, Sn)(H, X) as described above and they are incorporated while controlling the amount of them into the layer to be formed.

Referring specifically to the boron atoms introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$, and $B_6H_{14}$, and boron halides such as $BF_3$, $BCl_3$, and $BBr_3$. In addition, $AlCl_3$, $CaCl_3$, $Ga(CH_3)_2$, $InCl_3$, $TlCl_3$, and the like can also be mentioned.

Referring to the starting material for introducing the group V atoms and, specifically, to the phosphorus atoms introducing materials, they can include, fro example, phosphorus hydrides such as $PH_3$ and $P_2H_6$ and phosphous halides such as $PH_4I$, $PF_3$, $PF_5$, $PCl_3$, $PCl_5$, $PBr_3$, $PBr_5$, and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $BiCl_3$, and $BiBr_3$ can also be mentioned to as the effective starting material for introducing the group V atoms.

In the case of using the glow discharging process for forming the layer or layer region containing oxygen atoms, starting material for introducing the oxygen atoms is added to those selected from the group of the starting material as described above for forming the light receiving layer.

As the starting material for introducing the oxygen atoms, most of those gaseous or gasifiable materials can be used that comprise at least oxygen atoms as the constituent atoms.

For instance, it is possible to use a mixture of gaseous starting material comprising silicon atoms (Si) as the constituent atoms, gaseous starting material comprising oxygen atoms (O) as the constituent atom and, as required, gaseous starting material comprising hydrogen atoms (H) and/or halogen atoms (X) as the constituent atoms in a desired mixing ratio, a mixture of gaseous starting material comprising silicon atoms (Si) as the constituent atoms and gaseous starting material comprising oxygen atoms (O) and hydrogen atoms (H) as the constituent atoms in a desired mixing ratio, or a mixture of gaseous starting material comprising silicon atoms (Si) as the constituent atoms and gaseous starting material comprising silicon atoms (Si), oxygen atoms (O) and hydrogen atoms (H) as the constituent atoms.

Further, it is also possible to use a mixture of gaseous starting material comprising silicon atoms (Si) and hydrogen atoms (H) as the constituent atoms and gaseous starting material comprising oxygen atoms (O) as the constituent atoms.

Specifically, there can be mentioned, for example, oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes comprising silicon atoms (Si), oxygen atoms (O) and hydrogen atoms (H) as the constituent atoms, for example, disiloxane ($H_3SiOSiH_3$) and trisiloxane ($H_3SiOSiH_2OSiH_3$), etc.

In the case of forming the layer or layer region containing oxygen atoms by way of the sputtering process, it may be carried out by sputtering a single crystal or polycrystalline Si wafer or $SiO_2$ wafer, or a wafer containing Si and $SiO_2$ in admixture is used as a target and sputtered in various gas atmospheres.

For instance, in the case of using the Si wafer as the garget, a gaseous starting material for introducing oxygen atoms and, optionally, hydrogen atoms and/or halogen atoms is diluted as required with a dilution gas, introduced into a sputtering deposition chamber, gas plasmas with these gases are formed and the Si wafer is sputtered.

Alternatively, sputtering may be carried out in the atmosphere of a dilution gas or in a gas atmosphere containing at least hydrogen atoms (H) and/or halogen atoms (X) as constituent atoms as a sputtering gas by using individually Si and $SiO_2$ targets or a single Si and $SiO_2$ mixed target. As the gaseous starting material for introducing the oxygen atoms, the gaseous starting material for introducing the oxygen atoms as mentioned in the examples for the glow discharging process as described above can be used as the effective gas also in the sputtering.

Further, in the case of using the glow discharging process for forming the layer composed of a-Si containing carbon atoms, a mixture of gaseous starting material comprising silicon atoms (Si) as the constituent atoms, gaseous starting material comprising carbon atoms (C) as the constituent atoms and, optionally, gaseous starting material comprising hydrogen atoms (H) and/or halogen atoms (X) as the constituent atoms in a desired mixing ratio: a mixture of gaseous starting material comprising silicon atoms (Si) as the constituent atoms and gaseous starting material comprising carbon atoms (C) and hydrogen atoms (H) as the constituent atoms also in a desired mixing ratio: a mixture of gaseous starting material comprising silicon atoms (Si) as the constituent atoms and gaseous starting material comprising silicon atoms (Si), carbon atoms (C) and hydrogen atoms (H) as the constituent atoms: or a mixture of gaseous starting material comprising silicon atoms (Si) and hydrogen atoms (H) as the constituent atoms and gaseous starting material comprising carbon atoms (C) as constituent atoms are optionally used.

Those gaseous starting materials that are effectively usable herein can include gaseous silicon hydrides comprising C and H as the constituent atoms, such as silanes, for example, $SiH_4$, $Si_2H_6$, $Si_3H_8$ and $Si_4H_{10}$, as well as those comprising C and H as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$)

The gaseous starting material comprising Si, C and H as the constituent atoms can include silicified alkyls, for example, $Si(CH_3)_4$ and $Si(C_2H_5)_4$. In addition to these gaseous starting materials, $H_2$ can of course be used as the gaseous starting material for introducing H.

In the case of forming the layer composed of a-SiC (H, X) by way of the sputtering process, it is carried out by using a single crystal or polycrystalline Si wafer, a C (graphite) wafer or a wafer containing a mixture of Si and C as a target and sputtering them in a desired gas atmosphere.

In the case of using, for example a Si wafer as a target, gaseous starting material for introducing carbon atoms, and hydrogen atoms and/or halogen atoms in introduced while being optionally diluted with a dilution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous starting material for introducing hydrogen atoms and/or halogen atoms as the sputtering gas is optionally diluted with a dilution gas, introduced into a sputtering deposition chamber thereby forming gas plasmas and sputtering is carried out. As the gaseous starting material for introducing each of the atoms used in the sputtering process, those gaseous starting materials used in the glow discharging process as described above may be used as they are.

In the case of using the glow discharging process for forming the layer or the layer region containing the nitrogen atoms, starting material for introducing nitrogen atoms is added to the material selected as required from the starting materials for forming the light receiving layer as described above. the starting material for introducing the nitrogen atoms, most of gaseous or gasifiable materials can be used that comprise at least nitrogen atoms as the constituent atoms.

For instance, it is possible to use a mixture of gaseous starting material comprising silicon atoms (Si) as the constituent atoms, gaseous starting material comprising nitrogen atoms (N) as the constituent atoms and, optionally, gaseous starting material comprising hydrogen atoms (H) and/or halogen atoms (X) as the constituent atoms mixed in a desired mixing ratio, or a mixture of starting gaseous material comprising silicon atoms (Si) as the constituent atoms and gaseous starting material comprising nitrogen atoms (N) and hydrogen atoms (H) as the constituent atoms also in a desired mixing ratio.

Alternatively, it is also possible to use a mixture of gaseous starting material comprising nitrogen atoms (N) as the constituent atoms gaseous starting material comprising silicon atoms (Si) and hydrogen atoms (H) as the constituent atoms.

The starting material that can be used effectively as the gaseous starting material for introducing the nitrogen atoms (N) used upon forming the layer or layer region containing nitrogen atoms can include gaseous or gasifiable nitrogen, nitrides and nitrogen compounds such as azide compounds comprising N as the constituent atoms or N and H as the constituent atoms, for example, nitrogen ($N_2$), ammonia ($NH_3$), hydrazine ($H_2NNH_2$), hydrogen azide ($HN_3$) and ammonium azide ($NH_4N_3$). In addition, nitrogen halide compounds such as nitrogen trifluoride ($F_3N$) and nitrogen tetrafluoride ($F_4N_2$) can also be mentioned in that they can also introduce halogen atoms (X) in addition to the introduction of nitrogen atoms (N).

The layer or layer region containing the nitrogen atoms may be formed through the sputtering process by using a single crystal or polycrystalline Si wafer or $Si_3N_4$ wafer or a wafer containing Si and $Si_3N_4$ in admixture as a target and sputtering them in various gas atmospheres.

In the case of using a Si wafer as a target, for instance, gaseous starting material for introducing nitrogen atoms and, as required, hydrogen atoms and/or halogen atoms is diluted optionally with a dilution gas, introduced into a sputtering deposition chamber to form gas plasmas with these gases and the Si wafer is sputtered.

Alternatively, Si and $Si_3N_4$ may be used as individual targets or as a single target comprising Si and $Si_3N_4$ in admixture and then sputtered in the atmosphere of a dilution gas or in a gaseous atmosphere containing at least hydrogen atoms (H) and/or halogen atoms (X) as the constituent atoms as for the sputtering gas. As the gaseous starting material for introducing nitrogen atoms, those gaseous starting materials for introducing the nitrogen atoms described previously as mentioned in the example of the glow discharging as above described can be used as the effective gas also in the case of the sputtering.

As mentioned above, the light receiving layer of the light receiving member of this invention is produced by the glow discharge process or sputtering process. The amount of germanium atoms and/or tin atoms; the group III atoms or group V atoms; oxygen atoms, carbon atoms, or nitrogen atoms; and hydrogen atoms and/or halogen atoms in the light receiving layer is controlled by regulating the gas flow rate of each of the starting materials or the gas flow ratio among the starting materials respectively entering the deposition chamber.

The conditions upon forming the light receiving layer of the light receiving member of the invention, for example, the temperature of the support, the gas pressure in the deposition chamber, and the electric discharging power are important factors for obtaining the light receiving member having desired properties and they are properly selected while considering the functions of the layer to be made. Further, since these layer forming conditions may be varied depending on the kind and the amount of each of the atoms contained in the light receiving layer, the conditions have to be determined also taking the kind or the amount of the atoms to be contained into consideration.

For instance, in the case where the layer of a-Si (H, X) containing nitrogen atoms, oxygen atoms, carbon atoms, and the group III atoms or group V atoms, is to be formed, the temperature of the support is usually from 50° to 350° C. and, more preferably, from 50° to 250° C.; the gas pressure in the deposition chamber is usually from 0.01 to 1 Torr and, particularly preferably, from 0.1 to 0.5 Torr; and the electrical discharging power is usually from 0.005 to 50 W/cm$^2$, and, particularly, from 0.01 to 30 W/cm$^2$ and, particularly preferably, from 0.01 to 20 W/cm$^2$.

In the case where the layer of a-SiGe (H, X) is to be formed or the layer of a-SiGe (H, X) containing the group III atoms or the group V atoms, is to be formed, the temperature of the support is usually from 50° to 350° C., more preferably, from 50° to 300° C., most preferably 100° to 300° C.; the gas pressure in the deposition chamber is usually from 0.01 to 5 Torr, more preferably, from 0.001 to 3 Torr, most preferably from 0.1 to 1 Torr; and the electrical discharging power is usually from 0.005 to 50 W/cm$^2$, more preferably, from 0.01 to 30 W/cm$^2$, most preferably, from 0.01 to 20 W/cm$^2$.

However, the actual conditions for forming the layer such as temperature of the support, discharging power and the gas pressure in the deposition chamber cannot usually be determined with ease independent of each other. Accordingly, the conditions optimal to the layer formation are desirably determined based on relative and organic relationships for forming the amorphous material layer having desired properties.

By the way, it is necessary that the foregoing various conditions are kept constant upon forming the light receiving layer for unifying the distribution state of germanium atoms and/or tin atoms, oxygen atoms, carbon atoms, nitrogen atoms, the group III atoms or group V atoms, or hydrogen atoms and/or halogen atoms to be contained in the light receiving layer according to this invention.

Further, in the case of forming the light receiving layer comprising germanium atoms and/or tin atoms, oxygen atoms, carbon atoms, nitrogen atoms, or the group III atoms or group V atoms at a desired distribution state in the direction of the layer thickness by varying their distribution concentration in the direction of the layer thickness upon forming the light receiving layer in this invention, the layer is formed, for example, in the case of the glow discharging process, by properly varying the gas flow rate of gaseous starting material for introducing germanium atoms and/or tin atoms, oxygen atoms, carbon atoms, nitrogen atoms, or the group III atoms or group V atoms upon introducing into the depostion chamber in accordance with a desired variation coefficient while maintaining other conditions constant. Then, the gas flow rate may be varied, specifically, by gradually changing the opening degree of a predetermined needle valve disposed to the midway of the gas flow system, for example, manutally or any of other means usually employed such as in externally driving motor. In this case, the variation of the flow rate may not necessarily be linear but a desired content curve may be obtained, for example, by controlling the flow rate along with a previously designed variation coefficient curve by using a microcomputer or the like.

Further, in the case of forming the light receiving layer by way of the sputtering process, a desired distributed state of the germanium atoms and/or tin atoms, oxygen atoms, carbon atoms, nitrogen atoms, or the group III atoms or group V atoms in the direction of the layer thickness may be formed with the distribution density being varied in the direction of the layer thickness by using gaseous starting material for introducing the germanium atoms and/or tin atoms, oxygen atoms, carbon atoms, nitrogen atoms, or the group III atoms or group V atoms and varying the gas flow rate upon introducing these gases into the deposition chamber in accordance with a desired variation coefficient in the same manner as the case of using the glow discharging process.

DESCRIPTION OF THE PREFERRED EMBODIMENTS

The invention will be described more specifically while referring to Examples 1 through 10, but the invention is no way limited only to these Examples.

In each of the Examples, the light receiving layer was formed by using the glow discharging process.

Figure 38:
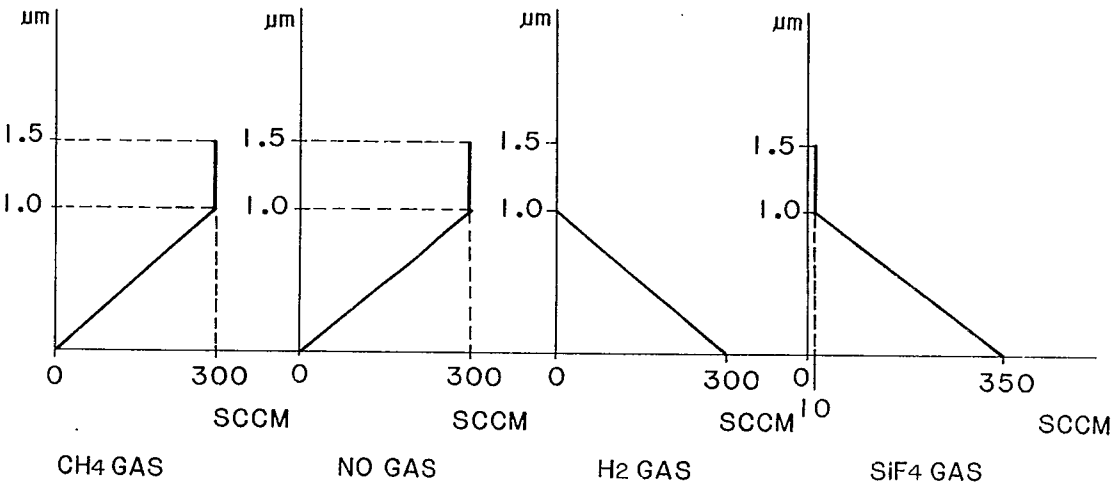

FIG. 38 shows an appratus for preparing a light receiving member according to this invention by means of the glow discharging process.

Gas reservoirs 2802, 2803, 2804, 2805, and 2806 illustrated in the figure are charged with gaseous starting materials for forming the respective layers in this invention, that is, for instance, $SiF_4$ gas (99.999% purity) in gas reservoirs 2802, $B_2H_6$ gas (99.999% purity) diluted with $H_2$ (referred to as $B_2H_6/H_2$) in gas reservoir 2803, $CH_4$ gas (99.999% purity) in gas reservoir 2804, $GeF_4$ gas (99.999% purity) in gas reservoir 2805, and inert gas (He) in gas reservoir 2806. $SnCl_4$ is held in a closed container 2806'.

Prior to the entrance of these gases into a reaction chamber 2801, it is confirmed that valves 2822–2826 for the gas reservoirs 2802–2806 and a leak valve 2835 are closed and that inlet valves 2812–2816, exit valves 2817–2821, and sub-valves 2832 and 2833 are opened. Then, a main valve 2834 is at first opened to evacuate the inside of the reaction chamber 2801 and gas piping. Reference is made in the following to an example in the case of forming a photosensitive layer and a surface layer on a vacuum Al cylinder 2837.

At first, $SiH_4$ gas from the gas reservoir 2802, $B_2H_6/H_2$ gas from the gas reservoir 2803, and $GeF_4$ gas from the gas reservoir 2805 are caused to flow into mass flow controllers 2807, 2808, and 2510 respectively by opening the inlet valves 2822, 2823, and 2825, controlling the pressure of exist pressure gauges 2827, 2828, and 2830 to k kg/cm$^2$. Subsequently, the exit valves 2817, 2818, and 2820, and the sub-valve 2832 are gradually opened to enter the gases into the reaction chamber 2801. In this case, the exist valves 2817, 2818, and 2820 are adjusted so as to attain a desired value for the ratio among the $SiF_4$ gas flow rate, $GeF_4$ gas flow rate, and $B_2H_6/H_2$ gas flow rate, and the opening of the main valve 2834 is adjusted while observing the reading on the vacuum gauge 2836 so as to obtain a desired value for the pressure inside the reaction chamber 2801. Then, after confirming that the temperature of the 2837 has been set by a heater 2838 within a range from 50° to 400° C., a power source 2840 is set to a predetermined electrical power to cause glow discharging in the reaction chamber 2801 while controlling the flow rates of $SiF_4$ gas, $GeF_4$ gas, $CH_4$ gas, and $B_2H_4/H_2$ gas in accordance with a previously designed variation coefficient curve by using a microcomputer (not shown), thereby forming, at first, a photosensitive layer containing silicon atoms, germanium atoms, and boron atoms on the substrate cylinder 2837.

Then, a surface layer is formed on the photosensitive layer. Subsequent to the procedures as described above, $SiF_4$ gas and $CH_4$ gas, for instance, are optionally diluted with a dilution gas such as He, Ar and $H_2$ respectively, entered at a desired gas flow rates into the reaction chamber 2801 while controlling the gas flow rate for the $SiF_4$ gas and the $CH_4$ gas in accordance with a previously designed variation coefficient curve by using a microcomputer and glow discharge being caused in accordance with predetermined conditions, by which a surface layer constituted with a-Si (H, X) containing carbon atoms is formed.

All of the exit valves other than those required for upon forming the respective layers are of course closed. Further, upon forming the respective layers, the inside of the system is once evacuated to a high vacuum degree as required by closing the exit valves 2817–2821 while opening the sub-valves 2832 and 2833 and fully opening the main valve 2834 for avoiding that the gases having been used for forming the previous layers are left in the reaction chamber 2801 and in the gas pipeways from the exit valves 2817–2821 to the inside of the reaction chamber 2801.

In addition, in the case of incorporating tin atoms into a photosensitive layer by using $SnCl_4$ as the starting material, $SnCl_4$ in solid state is introduced into the closed container 2806' wherein it is heated while blowing an inert gas such as Ar or He from the gas reservoir 2806 thereinto so as to cause bubbles to generate a gas of $SnCl_4$. The resulting gas is then introduced into the reaction chamber in the same procedures as above explained for $SiF_4$ gas, $GeF_4$ gas, $B_2H_2/H_2$ gas and the like.

TEST EXAMPLE

Figure 6:
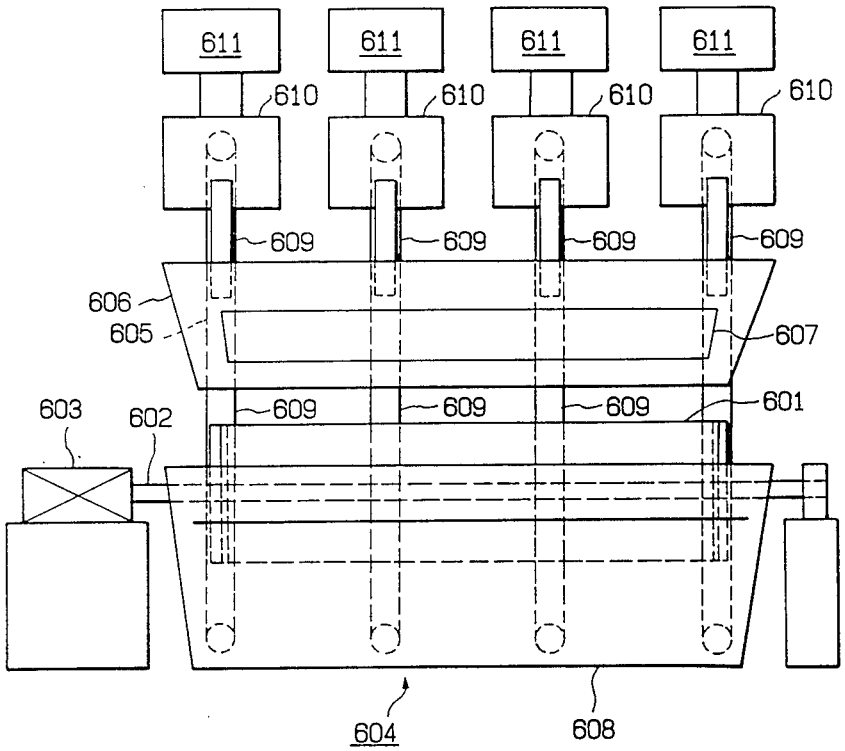
Figure 6:
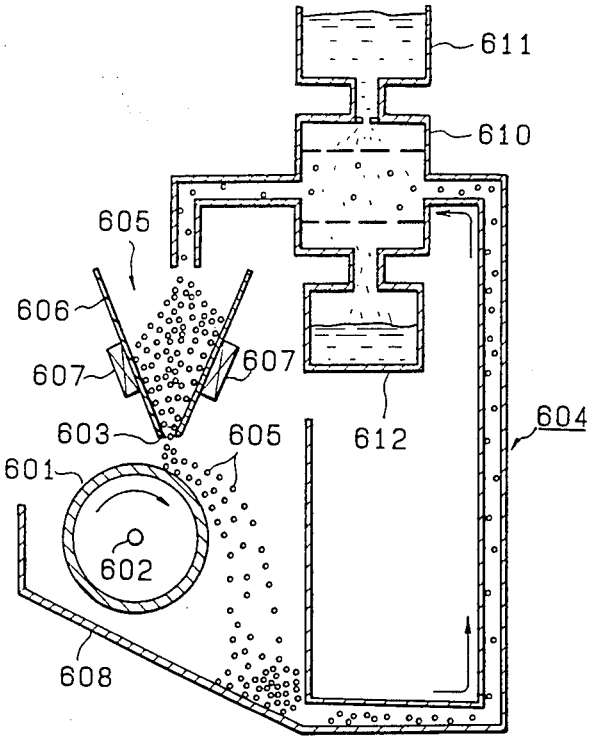

The surface of an aluminum alloy cylinder (60 mm in diameter and 298 mm in length) was fabricated to form an unevenness by using rigid true spheres of 2 mm in diameter made of SUS stainless steel in a device shown in FIG. 6 as described above.

When examining the relationship for the diameter R' of the true sphere, the falling height h, the radius of curvature R, and the width D for the dimple, it was confirmed that the radius of curvature R and the width D of the dimple was able to be determined depending on the conditions such as the diameter R' for the true sphere, the falling height h and the like. It was also confirmed that the pitch between each of the dimple (density of the dimples or the pitch for the unevenness) could be adjusted to a desired pitch by controlling the rotating speed or the rotation number of the cylinder, or the falling amount of the rigid true spheres.

EXAMPLE 1

The surface of an aluminum alloy cylinder was fabricated in the same manner as in the Test Example to obtain a cylindrical Al support- having diameter D and ratio D/R (cylinder Nos. 101 to 106) shown in the upper column of Table 1A.

Then, a light receiving layer was formed on each of the Al supports (cylinder Nos. 101 to 106) under the conditions shown in Table 1B below using the fabrication device shown in FIG. 28.

Figure 30:
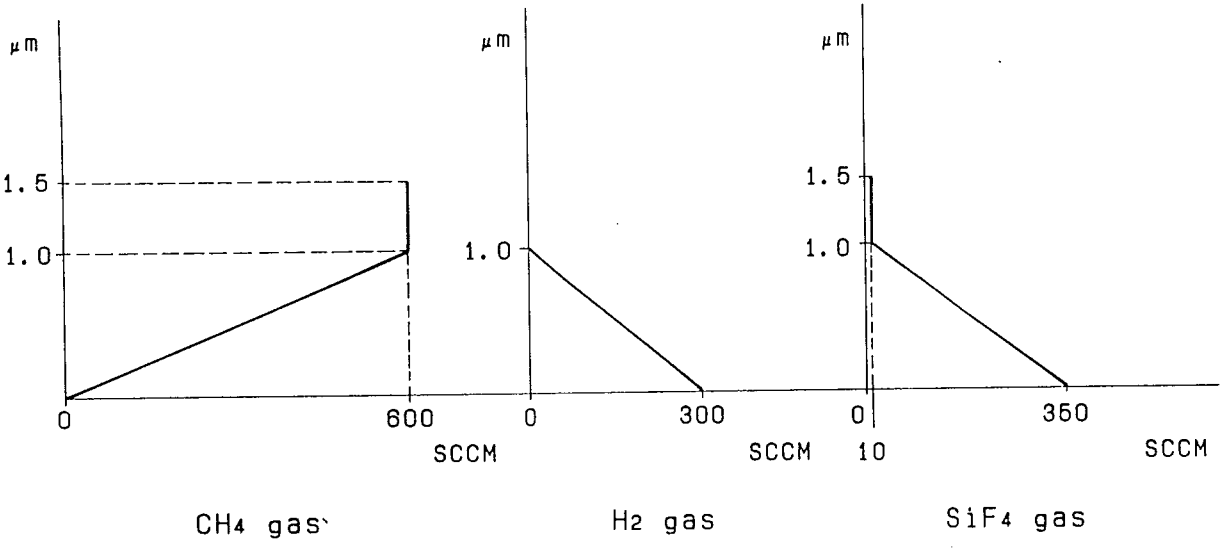
FIGS. 30 through 45 are views illustrating the variations in the gas flow rates in forming the light receiving layers according to this invention, wherein the ordinate represents the thickness of the photosensitive layer or the surface layer, and the abscissa represents the flow rate of a gas to be used.

In each of the cases, the flow rates of $CH_4$ gas, $H_2$ gas and $SiF_4$ gas in the formation of a surface layer were controlled automatically using a microcomputer in accordance with the flow rate curve as shown in FIG. 30.

Figure 29:
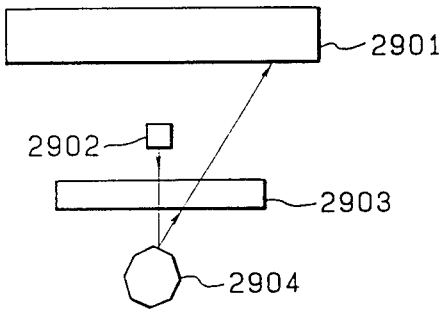
FIG. 29A and B is a view for illustrating the image exposing device by the laser beams.
Figure 29:
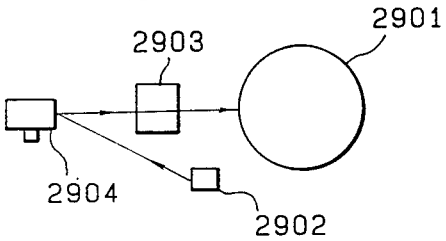

These light receiving members were subjected to imagewise exposure by irradiating laser beams at 780 nm wavelength and with 80 μm spot diameter using an image exposing device shown in FIG. 29 and images were obtained by subsequent development and transfer. The state of the occurrence of interference fringe on the thus obtained images were as shown in the lower row of Table 1A.

FIG. 29(A) is a schematic plan view illustrating the entire exposing device, and FIG. 29(B) is a schematic side elevational view for the entire device. In the figures, are shown a light receiving member 2901, a semiconductor laser 2902, an fθ lens 2903, and a polygonal mirror 2904.

Then as a comparison, a light receiving member was manufactured in the same manner as described above by using an aluminum alloy cylinder, the surface of which was fabricated with a conventional cutting tool (60 mm in diameter, 298 mm in length, 100 μm unevenness pitch, and 3 μm unevenness depth). When observing the thus obtained light receiving member under an electron microscope, the layer interface between the support surface and the light receiving layer and the surface of the light receiving layer were in parallel with each other. Images were formed in the same manner as above by using this light receiving member and the thus obtained images were evaluated in the same manner as described above. The results are as shown in the lower row of Table 1A.

TABLE 1A

| Cylinder No. | 101 | 102 | 103 | 104 | 105 | 106 | 107 |
|---|---|---|---|---|---|---|---|
| D (μm) | 450 ± 50 | 450 ± 50 | 450 ± 50 | 450 ± 50 | 450 ± 50 | 450 ± 50 | — |
| D/R | 0.02 | 0.03 | 0.04 | 0.05 | 0.06 | 0.07 | — |
| Occurrence of interference fringes | x | Δ | ○ | ○ | ◎ | ◎ | x |

Actual usability: ◎: excellent, ○: good, Δ: fair, x: poor

TABLE 1B (See FIG. 30 for flow rate curve)

| Layer constitution | Layer preparing steps | Gas used | Flow rate (SCCM) | Discharging power (W) | Layer thickness (μ) |
|---|---|---|---|---|---|
| Photosensitive layer | 1st step | $SiF_4$<br>$GeF_4$<br>$H_2$ | $SiF_4 = 50$<br>$GeF_4 = 300$<br>$H_2 = 300$ | 250 | 3 |
| | 2nd step | $SiF_4$<br>$H_2$ | $SiF_4 = 350$<br>$H_2 = 300$ | 300 | 22 |
| Surface layer | 3rd step | $SiF_4$<br>$H_2$<br>$CH_4$ | $SiF_4 = 350 \rightarrow 10$<br>$H_2 = 300 \rightarrow 0$<br>$CH_4 = 0 \rightarrow 600$ | 300 → 200 | 1.5 |

Al substrate temperature: 250° C.
Discharging frequency: 13.56 MHz

EXAMPLE2

A light receiving layer was formed on each of the Al supports (cylinder Nos. 101 to 107) in the same manner as in Example 1, except that these light receiving layers were formed in accordance with the layer forming conditions shown in Table 2B.

Figure 31:
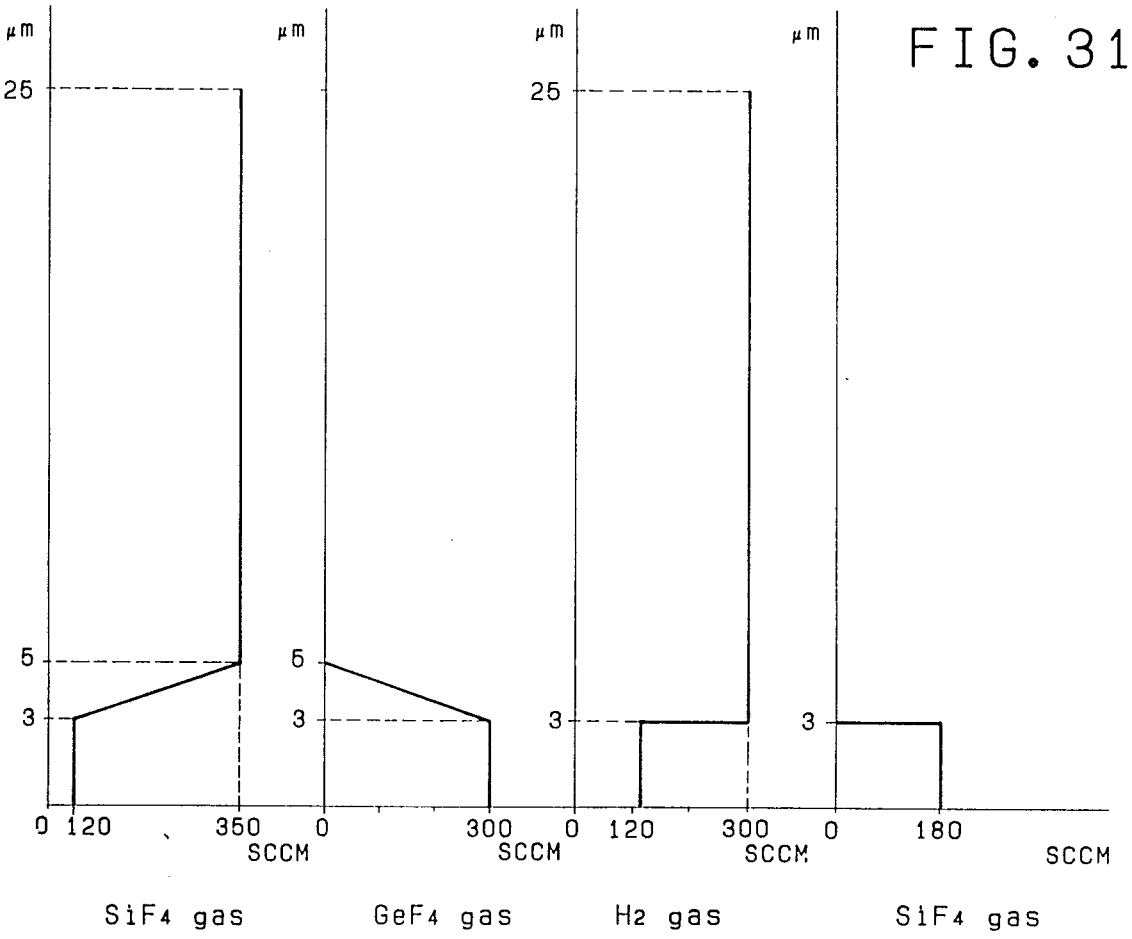
Figure 32:
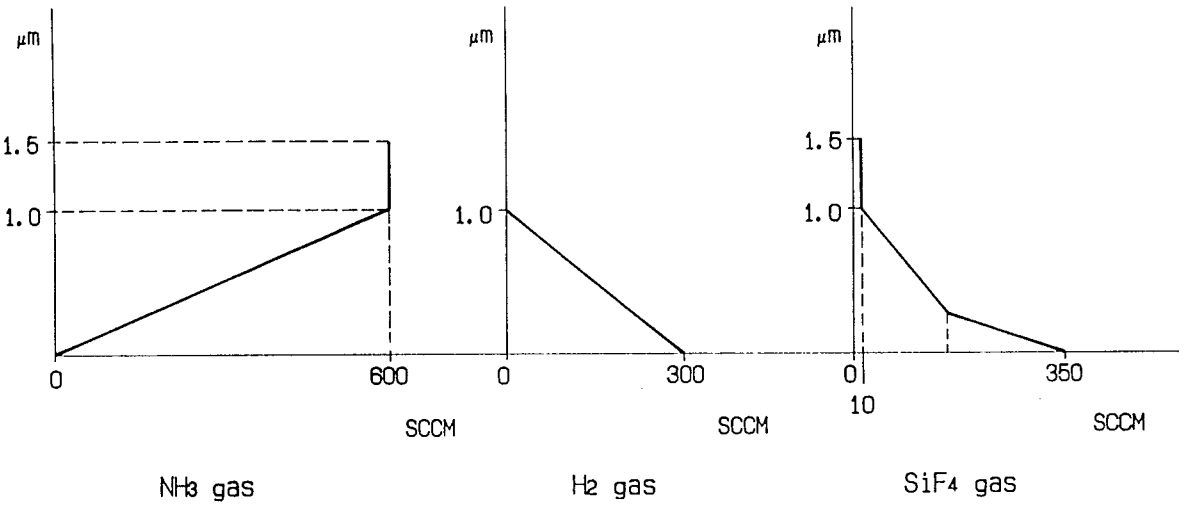

Incidentally, the flow rates of $GeF_4$ gas and $SiF_4$ gas in the formation of a photosensitive layer and the flow rates of $NH_3$ gas, $H_2$ gas and $SiF_4$ gas were controlled automatically using a microcomputer respectively in accordance with the flow rate curve as shown in FIG. 31 and that as shown in FIG. 32.

And as for the boron atoms to be contained into the photosensitive layer, they were so introduced to provide a ratio: $B_2H_6/SiF_4 \approx 100$ ppm and that they were doped to be about 200 ppm over the entire layer region.

When forming the images on the thus obtained light receiving members in the same manner as in Example 1, the state of occurrence of the interference fringe in the obtained images were as shown in the lower row of Table 2A.

TABLE 2A

| Cylinder No. | 101 | 102 | 103 | 104 | 105 | 106 | 107 |
|---|---|---|---|---|---|---|---|
| D (μm) | 450 ± 50 | 450 ± 50 | 450 ± 50 | 450 ± 50 | 450 ± 50 | 450 ± 50 | — |
| D/R | 0.02 | 0.03 | 0.04 | 0.05 | 0.06 | 0.07 | — |
| Occurrence of interference | x | Δ | ○ | ○ | ◎ | ◎ | x |

TABLE 2A-continued

| Cylinder No. | 101 | 102 | 103 | 104 | 105 | 106 | 107 |
|---|---|---|---|---|---|---|---|
| fringes | | | | | | | |

Actual usability:◉: excellent, ○: good, Δ: fair, x: poor

TABLE 2B (See FIG. 31,32 for flow rate curve)

| Layer constitution | Layer preparing steps | Gas used | Flow rate (SCCM) | Discharging power (W) | Layer thickness (μ) |
|---|---|---|---|---|---|
| Photosensitive layer | 1st step | $SiF_4$<br>$GeF_4$<br>$H_2$<br>$B_2H_6/H_2$ | $SiF_4 = 50$<br>$GeF_4 = 300$<br>$H_2 = 120$<br>$B_2H_6/H_2 = 180$ | 250 | 3 |
| | 2nd step | $SiF_4$<br>$GeF_4$<br>$H_2$ | $SiF_4 = 50 \rightarrow 350$<br>$GeF_4 = 300 \rightarrow 0$<br>$H_2 = 300$ | 250 | 2 |
| | 3rd step | $SiF_4$<br>$H_2$ | $SiF_4 = 350$<br>$H_2 = 300$ | 300 | 20 |
| Surface layer | 4th step | $SiF_4$<br>$H_2$<br>$NH_2$ | $SiF_4 = 350 \rightarrow 10$<br>$H_2 = 300 \rightarrow 0$<br>$NH_3 = 0 \rightarrow 600$ | 300 → 200 | 1.5 |

Al substrate temperature: 250° C.
Discharging frequency: 13.56 MHz

EXAMPLES 3 to 11

A light receiving layer was formed on each of the Al supports (Sample Nos. 103 to 106) in the same manner as in Example 1, except that these light receiving layers in accordance with the layer forming conditions shown in Tables 3through 10. In these examples, the flow rates for the gases used upon forming the photosensitive layers and the surface layers were automatically adjusted under the microcomputer control in accordance with the flow rate variation curves shown in FIGS. 33 through 45, respectively as mentioned in Table 11.

And boron atoms were introduced in the same way as mentioned in Example 2.

Images were formed on the thus obtained light receiving members in the same manner as in Example 1. interference fringe was not observed in any of the thus obtained images and the image quality was extremely high.

TABLE 3

Figure 33:
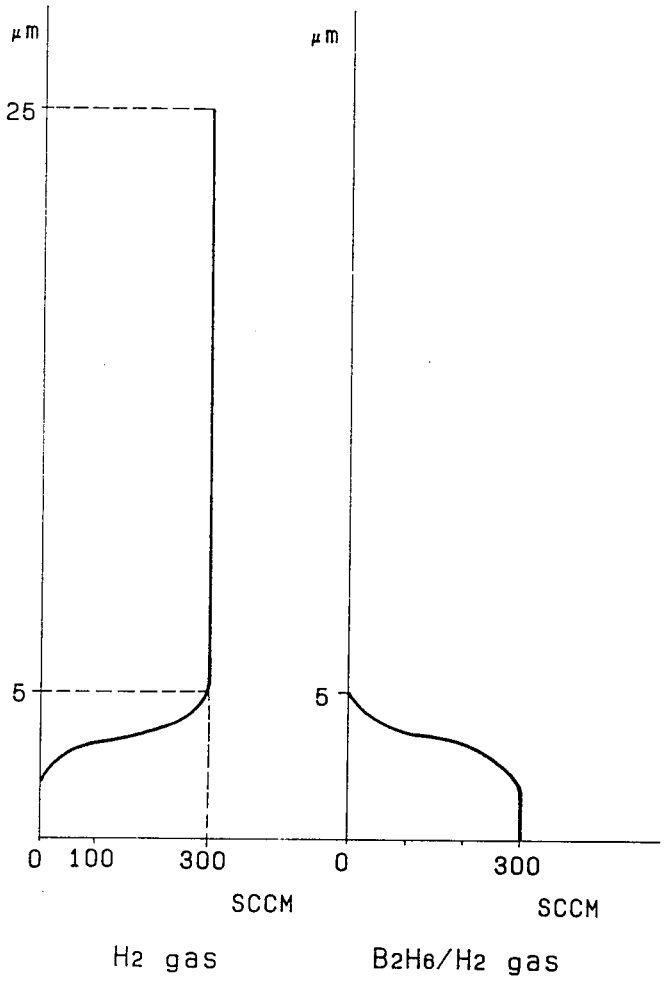

(See FIG. 33,34 for flow rate curve)

| Layer constitution | Layer preparing steps | Gas used | Flow rate (SCCM) | Discharging power (W) | Layer thickness (μ) |
|---|---|---|---|---|---|
| Photosensitive layer | 1st step | $SiF_4$<br>$GeF_4$<br>$H_2$<br>$B_2H_6/H_2$ | $SiF_4 = 50$<br>$GeF_4 = 300$<br>$H_2 = \rightarrow 300$<br>$B_2H_6/H_2 = 300 \rightarrow 0$ | 250 | 5 |
| | 2nd step | $SiF_4$<br>$H_2$ | $SiF_4 = 350$<br>$H_2 = 300$ | 300 | 20 |
| Surface layer | 3rd step | $SiF_4$<br>$H_2$<br>NO | $SiF_4 = 350 \rightarrow 100$<br>$H_2 = 300 \rightarrow 0$<br>$NO = 0 \rightarrow 500$ | 300 → 200 | 1.5 |

Al substrate temperature: 250° C.
Discharging frequency: 13.56 MHz

TABLE 4

Figure 35:
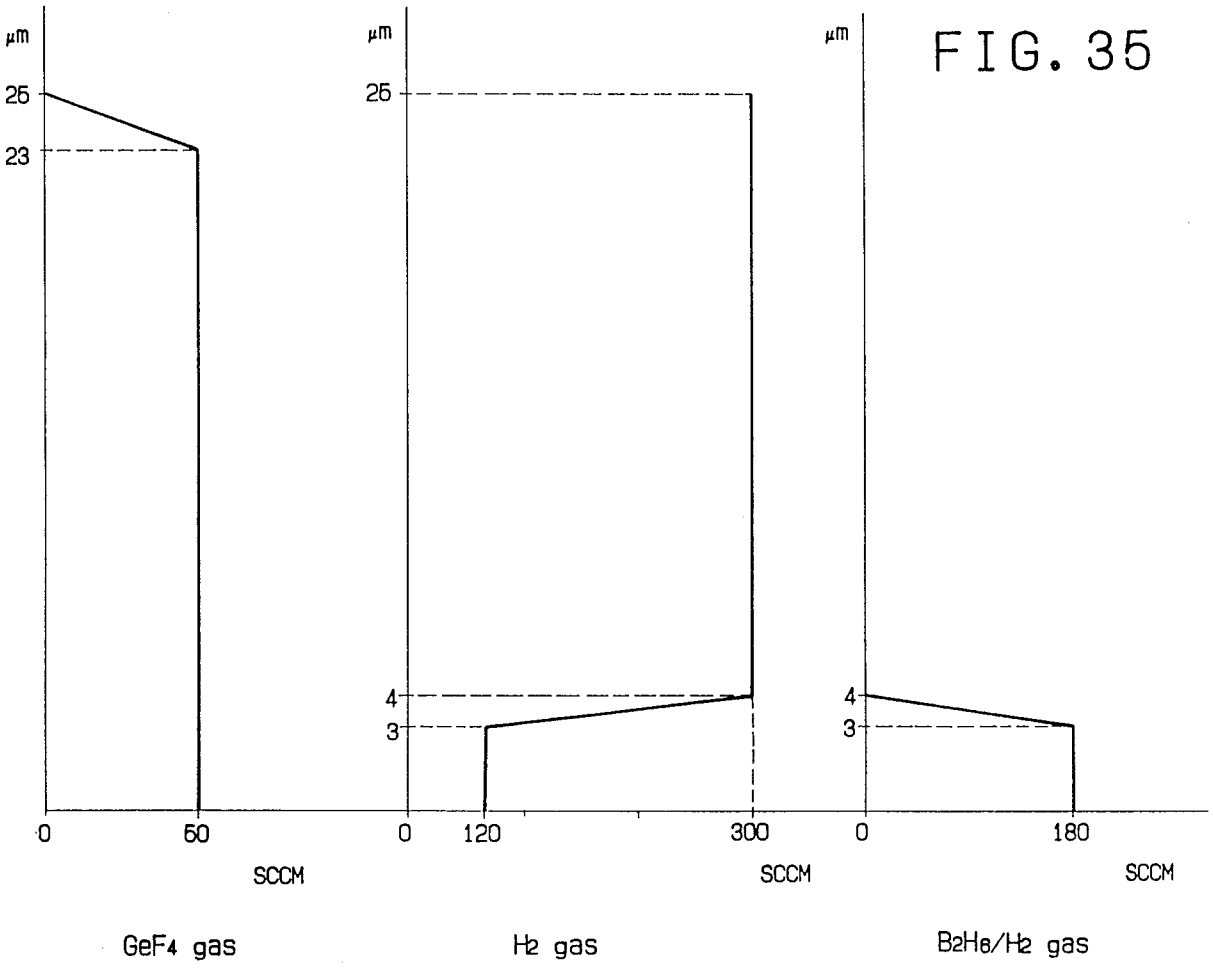

(See FIG. 35,36 for flow rate curve)

| Layer constitution | Layer preparing steps | Gas used | Flow rate (SCCM) | Discharging power (W) | Layer thickness (μ) |
|---|---|---|---|---|---|
| Photosensitive layer | 1st step | $SiF_4$<br>$GeF_4$<br>$H_2$<br>$B_2H_6/H_2$ | $SiF_4 = 300$<br>$GeF_4 = 50$<br>$H_2 = 120$<br>$B_2H_6/H_2 = 180$ | 300 | 3 |
| | 2nd step | $SiF_4$<br>$GeF_4$<br>$H_2$<br>$B_2H_6/H_2$ | $SiF_4 = 300$<br>$GeF_4 = 50$<br>$H_2 = 120 \rightarrow 300$<br>$B_2H_6/H_2 = 180 \rightarrow 0$ | 300 | 1 |
| | 3rd step | $SiF_4$<br>$GeF_4$<br>$H_2$ | $SiF_4 = 300$<br>$GeF_4 = 50$<br>$H_2 = 300$ | 300 | 19 |
| | 4th step | $SiF_4$<br>$GeF_4$<br>$H_2$ | $SiF_4 = 300$<br>$GeF_4 = 50 \rightarrow 0$<br>$H_2 = 300$ | 300 | 2 |
| Surface layer | 5th step | $SiF_4$<br>$H_2$<br>$NH_2$ | $SiF_4 = 350 \rightarrow 10$<br>$H_2 = 300 \rightarrow 0$<br>$NH_3 = 0 \rightarrow 600$ | 300 → 200 | 1.5 |

Al substrate temperature: 250° C.
Discharging frequency: 13.56 MHz

TABLE 5

Figure 37:
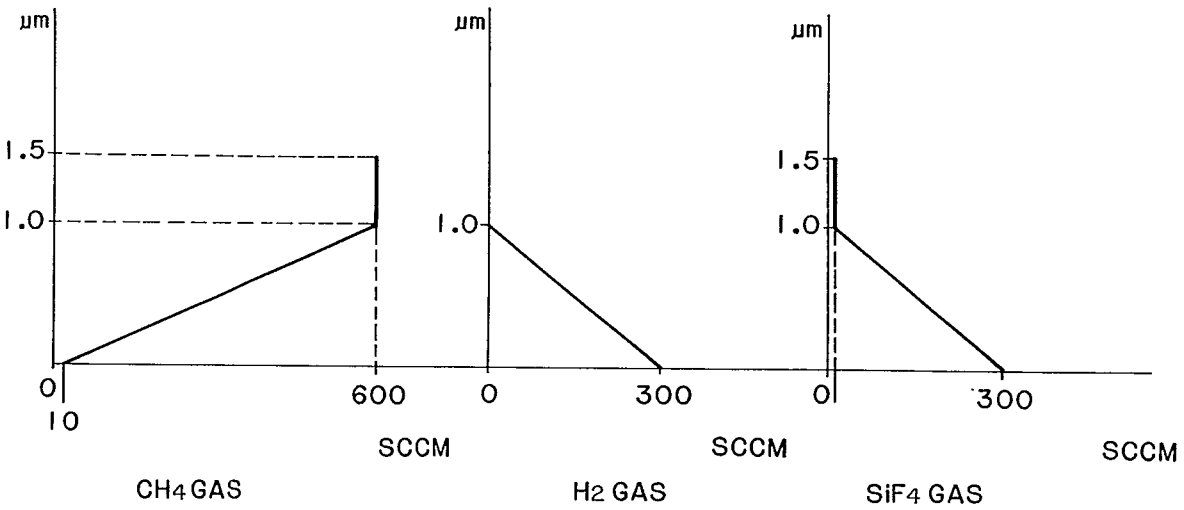

(See FIG. 37 for flow rate curve)

| Layer constitution | Layer preparing steps | Gas used | Flow rate (SCCM) | Discharging power (W) | Layer thickness (μ) |
|---|---|---|---|---|---|
| Photosensitive layer | 1st step | $SiF_4$<br>$GeF_4$<br>$H_2$<br>$CH_4$ | $SiF_4 = 50$<br>$GeF_4 = 250$<br>$H_2 = 300$<br>$CH_4 = 10$ | 250 | 3 |
| | 2nd step | $SiF_4$<br>$H_2$<br>$CH_4$ | $SiF_4 = 300$<br>$H_2 = 300$<br>$CH_4 = 10$ | 300 | 22 |
| Surface layer | 3rd step | $SiF_4$<br>$H_2$<br>$CH_4$ | $SiF_4 = 300 \rightarrow 10$<br>$H_2 = 300 \rightarrow 0$<br>$CH_4 = 0 \rightarrow 600$ | 300 → 200 | 1.5 |

Al substrate tamperature: 250° C.
Discharging frequency: 13.56 MHz

TABLE 6

(See FIG. 38 for flow rate curve)

| Layer constitution | Layer preparing steps | Gas used | Flow rate (SCCM) | Discharging power (W) | Layer thickness (μ) |
|---|---|---|---|---|---|
| Photosensitive layer | 1st step | $SiF_4$<br>$GeF_4$<br>$H_2$<br>$CH_4$ | $SiF_4 = 300$<br>$GeF_4 = 50$<br>$H_2 = 300$<br>$CH_4 = 10$ | 300 | 3 |
| | 2nd step | $SiF_4$<br>$GeF_4$<br>$H_2$ | $SiF_4 = 300$<br>$GeF_4 = 50$<br>$H_2 = 300$ | 300 | 20 |
| | 3rd step | $SiF_4$<br>$H_2$ | $SiF_4 = 350$<br>$H_2 = 300$ | 300 | 2 |
| Surface layer | 4th step | $SiF_4$<br>$H_2$<br>$CH_4$<br>NO | $SiF_4 = 350 \rightarrow 10$<br>$H_2 = 300 \rightarrow 0$<br>$CH_4 = 0 \rightarrow 300$<br>$NO = 0 \rightarrow 300$ | 300 → 200 | 1.5 |

Al substrate tamperature: 250° C.
Discharging frequency: 13.56 MHz

TABLE 7

Figure 39:
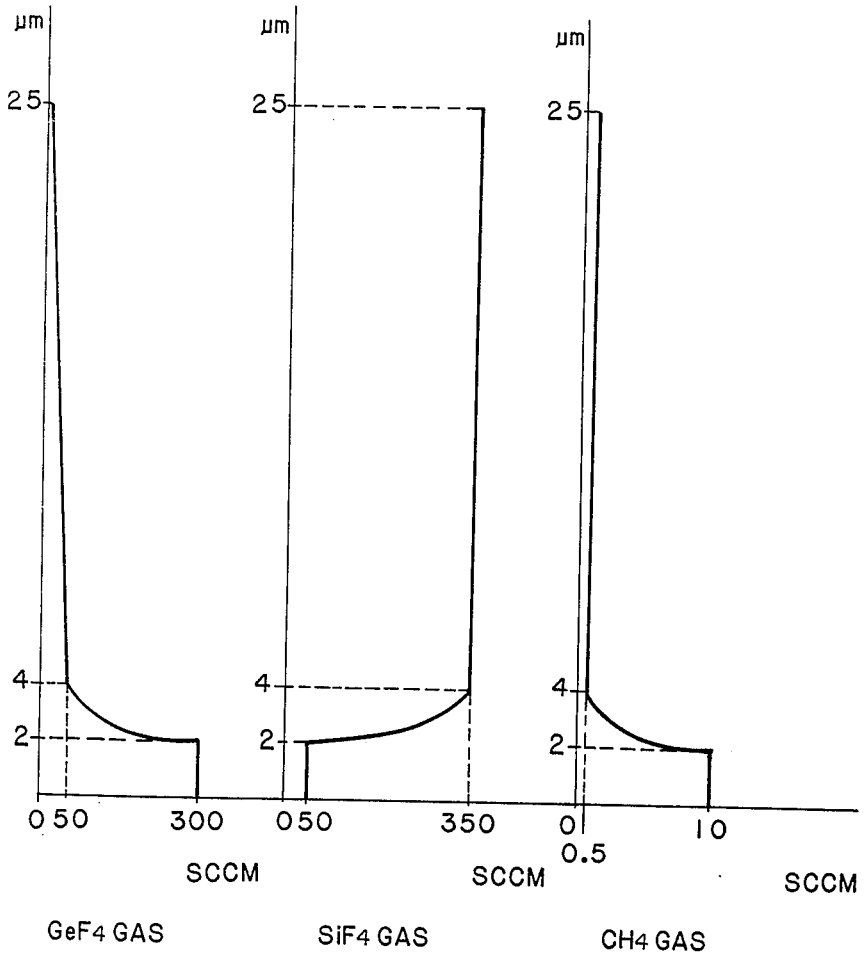

(See FIG. 39,40 for flow rate curve)

| Layer constitution | Layer preparing steps | Gas used | Flow rate (SCCM) | Discharging power (W) | Layer thickness (μ) |
|---|---|---|---|---|---|
| Photosensitive layer | 1st step | $SiF_4$<br>$GeF_4$<br>$H_2$<br>$CH_4$ | $SiF_4 = 50$<br>$GeF_4 = 300$<br>$H_2 = 300$<br>$CH_4 = 10$ | 250 | 2 |
| | 2nd step | $SiF_4$<br>$GeF_4$<br>$H_2$<br>$CH_4$ | $SiF_4 = 50 \rightarrow 350$<br>$GeF_4 = 300 \rightarrow 50$<br>$H_2 = 300$<br>$CH_4 = 10 \rightarrow 0.5$ | 250 → 300 | 2 |
| | 3rd step | $SiF_4$<br>$GeF_4$<br>$H_2$<br>$CH_4$ | $SiF_4 = 350$<br>$GeF_4 = 50 \rightarrow 0$<br>$H_2 = 300$<br>$CH_4 = 0.5$ | 300 | 21 |
| Surface layer | 4th step | $SiF_4$<br>$H_2$<br>$CH_4$ | $SiF_4 = 350 \rightarrow 10$<br>$H_2 = 300 \rightarrow 0$<br>$CH_4 = 0.5 \rightarrow 600$ | 300 → 200 | 1.5 |

Al substrate temperature: 250° C.
Discharging frequency: 13.56 MHz

TABLE 8

Figure 41:
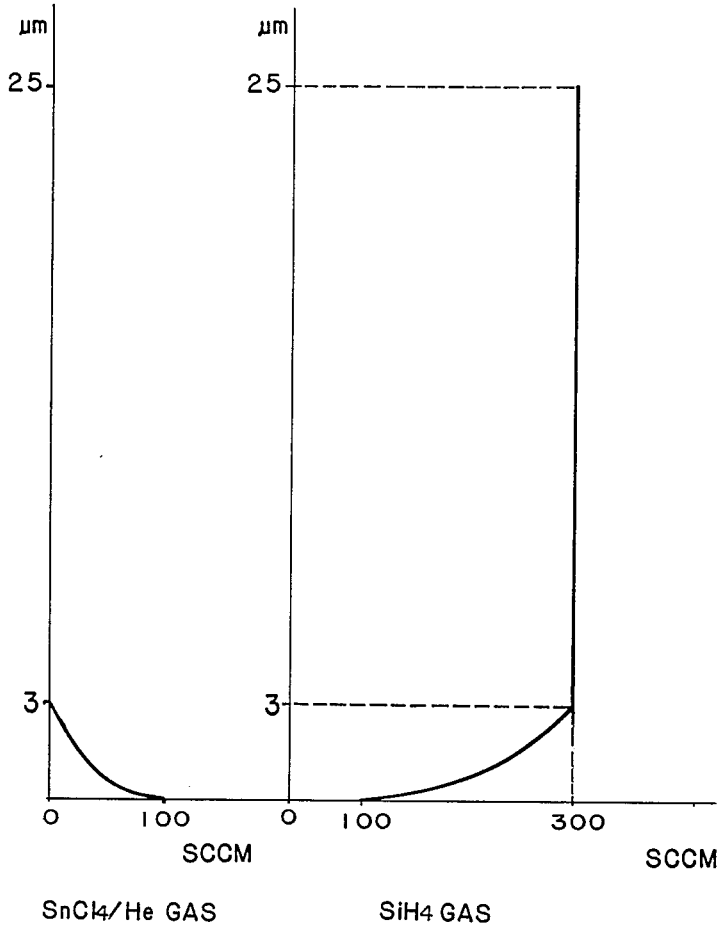

(See FIG. 41,42 for flow rate curve)

| Layer constitution | Layer preparing steps | Gas used | Flow rate (SCCM) | Discharging power (W) | Layer thickness (μ) |
|---|---|---|---|---|---|
| Photosensitive layer | 1st step | $SiH_4$<br>$SnCl_4$/He<br>$N_2$ | $SiH_4 = 100 \rightarrow 300$<br>$SnCl_4$/He $= 100 \rightarrow 0$<br>$N_2 = 5$ | 180 → 300 | 3 |
| | 2nd step | $SiH_4$<br>$N_2$ | $SiH_4 = 300$<br>$N_2 = 5$ | 300 | 22 |
| Surface layer | 3rd step | $SiH_4$<br>$N_2$ | $SiH_4 = 300 \rightarrow 10$<br>$N_2 = 5 \rightarrow 600$ | 300 → 200 | 1.5 |

Al substrate temperature: 250° C.
Discharging frequency: 13.56 MHz

TABLE 9

Figure 43:
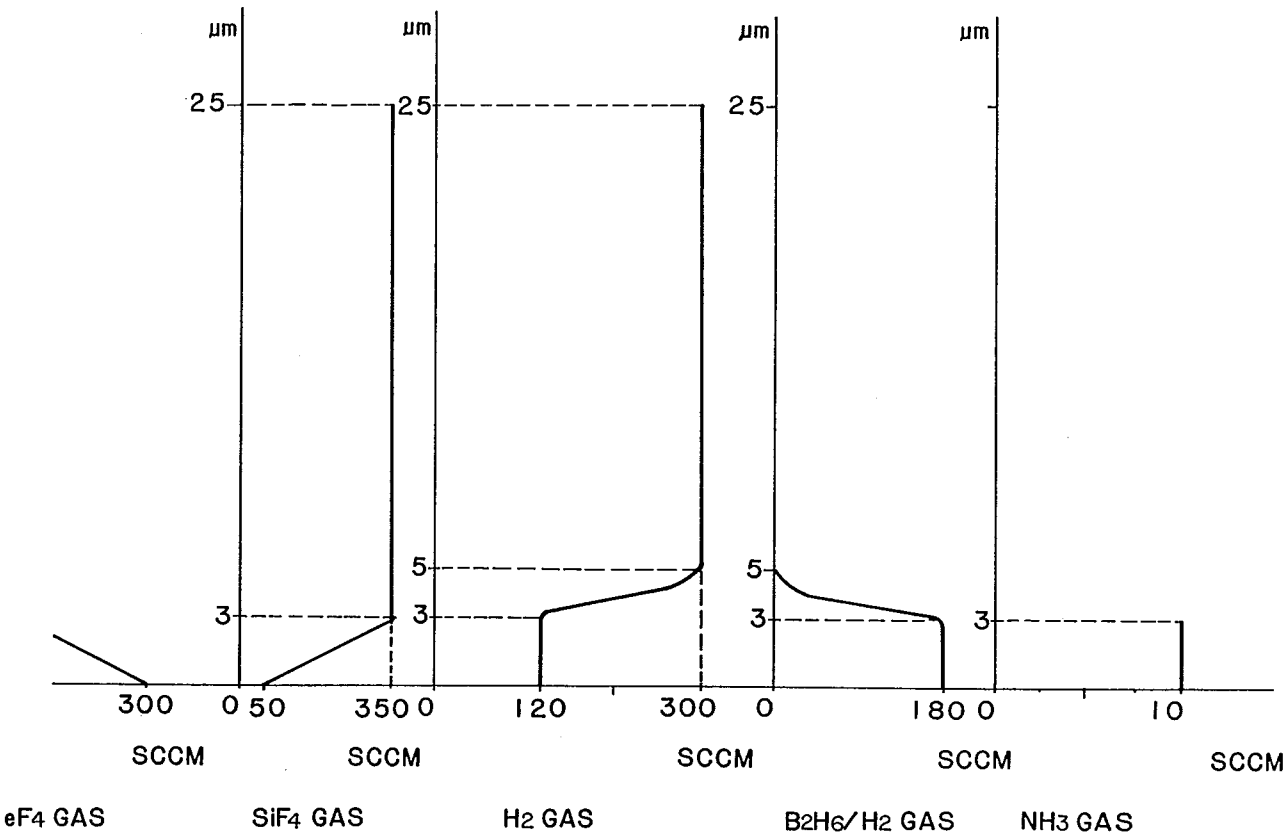

(See FIG. 43,44 for flow rate curve)

| Layer constitution | Layer preparing steps | Gas used | Flow rate (SCCM) | Discharging power (W) | Layer thickness (μ) |
|---|---|---|---|---|---|
| Photosensitive layer | 1st step | $SiF_4$<br>$GeF_4$<br>$H_2$<br>$NH_3$<br>$B_2H_6$/$H_2$ | $SiF_4 = 50 \rightarrow 350$<br>$GeF_4 = 300 \rightarrow 0$<br>$H_2 = 120$<br>NHhd 3 = 10<br>$B_2H_6/H_2 = 180$ | 250 → 300 | 3 |
| | 2nd step | $SiF_4$<br>$H_2$<br>$B_2H_6$/$H_2$ | $SiF_4 = 350$<br>$H_2 = 120 \rightarrow 300$<br>$B_2H_6$/$H_2 = 180 \rightarrow 0$ | 300 | 2 |
| | 3rd step | $SiF_4$<br>$H_2$ | $SiF_4 = 350$<br>$H_2 = 300$ | 300 | 20 |
| Surface layer | 4th step | $SiF_4$<br>$H_2$<br>NO | $SiF_4 = 350 \rightarrow 100$<br>$H_2 = 300 \rightarrow 0$<br>$NO = 0 \rightarrow 500$ | 300 → 200 | 1.5 |

Al substrate temperature: 250° C.
Discharging frequency: 13.56 MHz

TABLE 10

Figure 45:
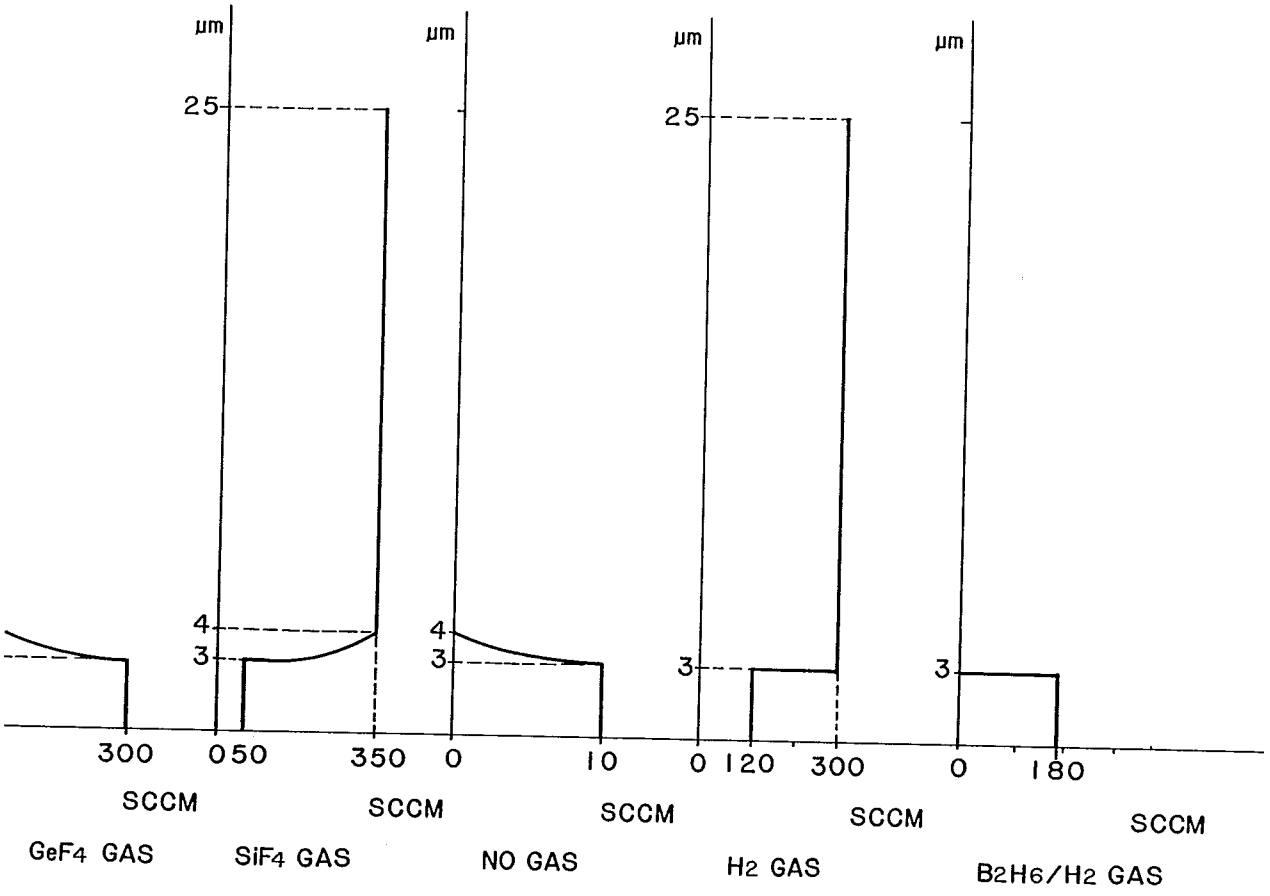

(See FIG. 45,38 for flow rate curve)

| Layer constitution | Layer preparing steps | Gas used | Flow rate (SCCM) | Discharging power (W) | Layer thickness (μ) |
|---|---|---|---|---|---|
| Photosensitive layer | 1st step | $SiF_4$<br>$GeF_4$<br>$H_2$<br>NO<br>$B_2H_6$/$H_2$ | $SiF_4 = 50$<br>$GeF_4 = 300$<br>$H_2 = 120$<br>$NO = 10$<br>$B_2H_6$/$H_2 = 180$ | 250 | 3 |
| | 2nd step | $SiF_4$<br>$GeF_4$<br>$H_2$<br>NO | $SiF_4 = 350$<br>$GeF_4 = 300 \rightarrow 0$<br>$H_2 = 300$<br>$NO = 10 \rightarrow 0$ | 250 → 300 | 1 |
| | 3rd step | $SiF_4$<br>$H_2$ | $SiF_4 = 350$<br>$H_2 = 300$ | 300 | 21 |
| Surface layer | 4th step | $SiF_4$<br>$H_2$<br>$CH_4$<br>NO | $SiF_4 = 350 \rightarrow 10$<br>$H_2 = 300 \rightarrow 0$<br>$CH_4 = \rightarrow 300$<br>$NO = 0 \rightarrow 300$ | 300 → 200 | 1.5 |

Al substrate temperature: 250° C.
Discharging frequency: 13.56 MHz

TABLE 11

Figure 34:
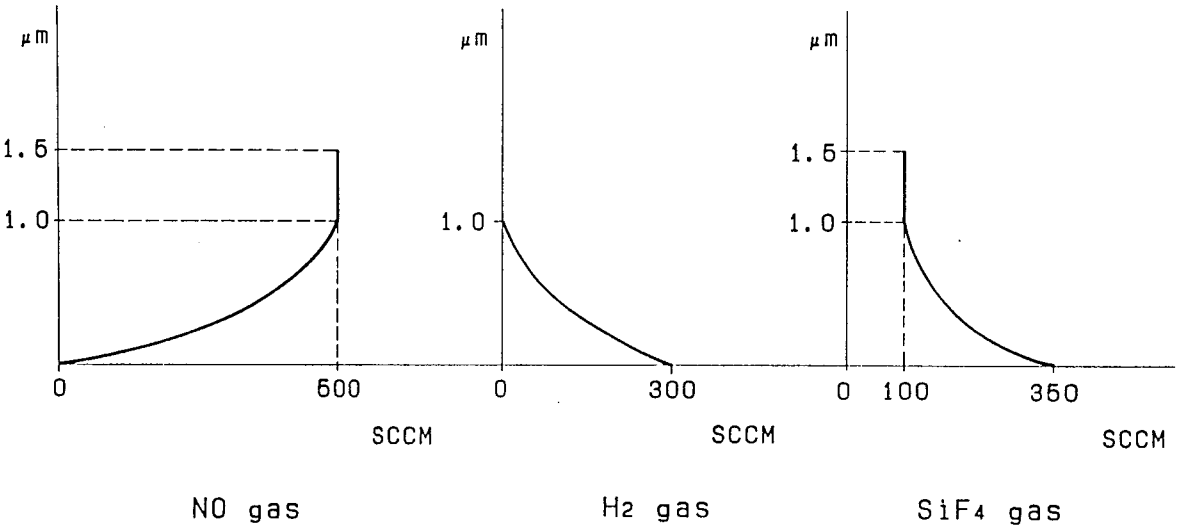
Figure 36:
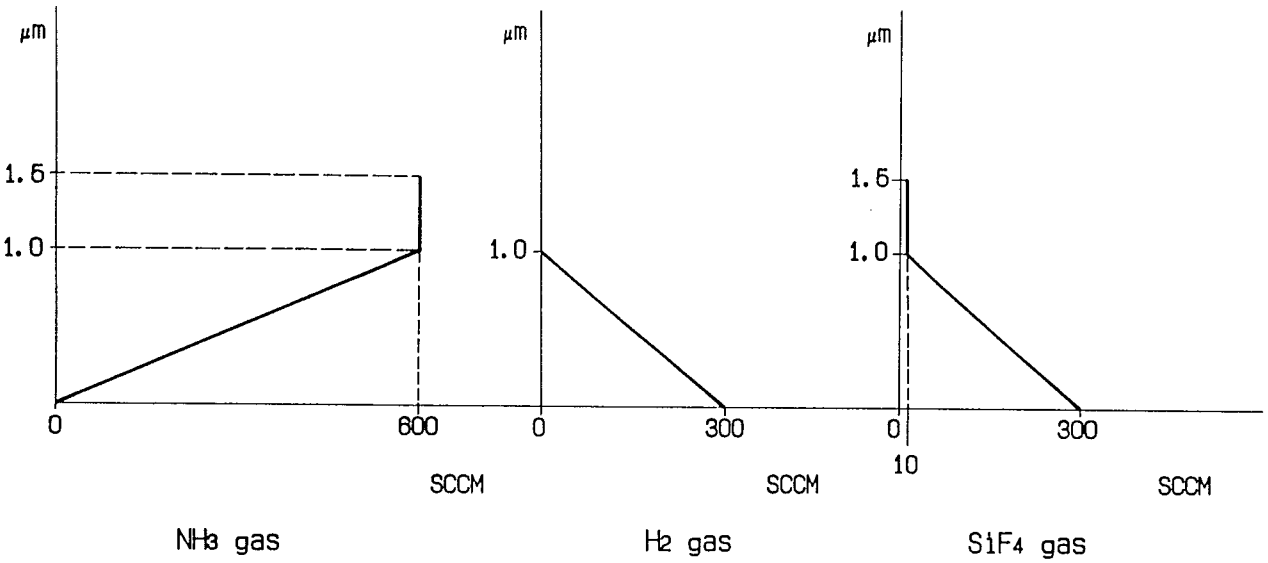
Figure 40:
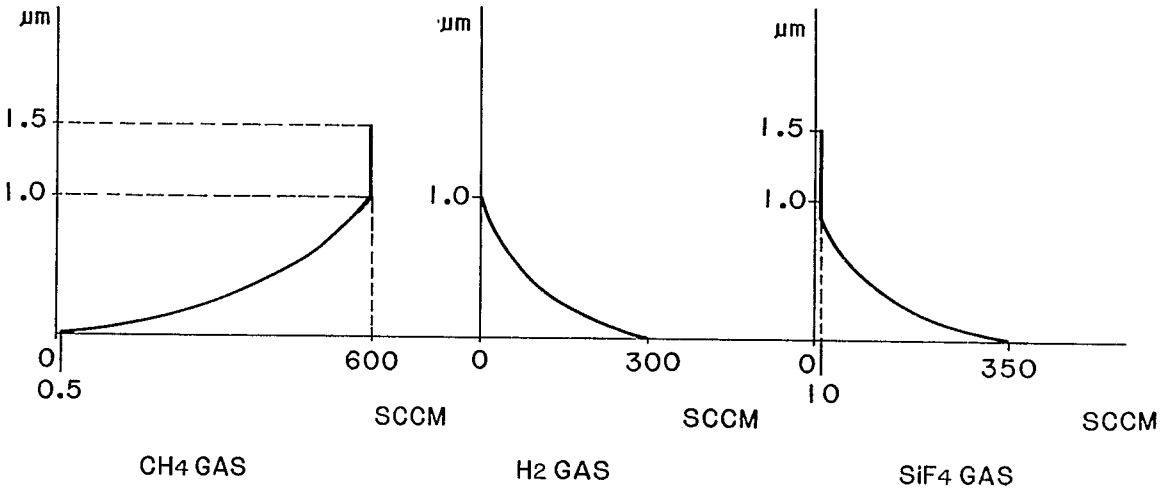
Figure 42:
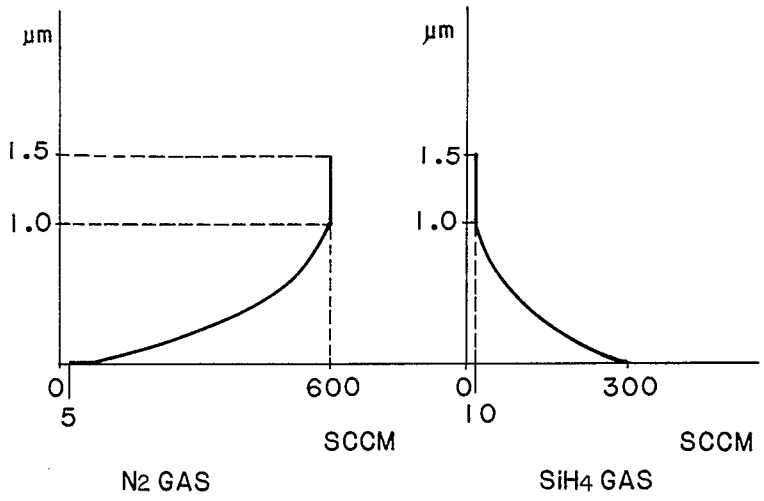
Figure 44:
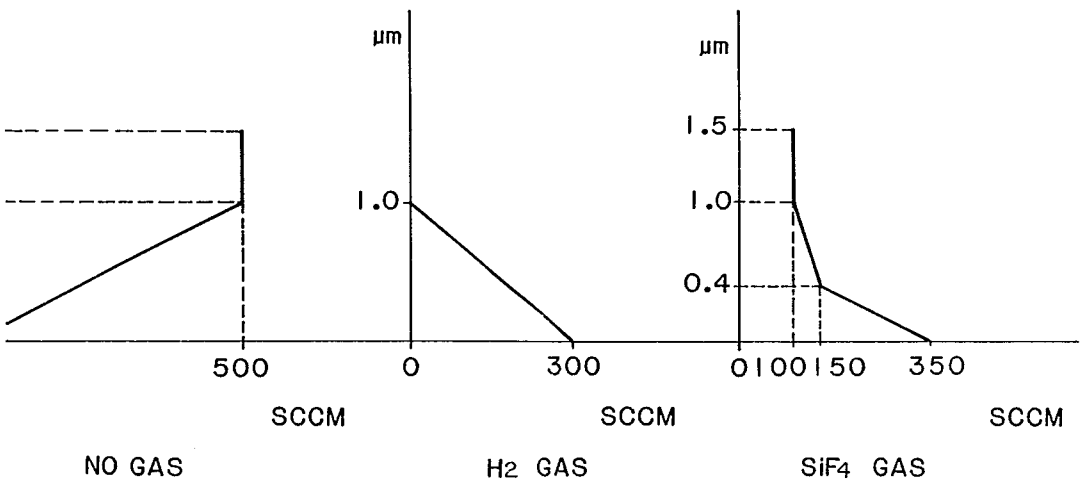

| Example No. | Chart showing the flow rate change of gas used in forming photosensitive layer | Chart showing the flow rate change of gas used in forming surface layer |
|---|---|---|
| 3 | FIG. 33 | FIG. 34 |
| 4 | FIG. 35 | FIG. 36 |
| 5 | — | FIG. 37 |
| 6 | — | FIG. 38 |
| 7 | FIG. 39 | FIG. 40 |
| 8 | FIG. 41 | FIG. 42 |
| 9 | FIG. 43 | FIG. 44 |
| 10 | FIG. 45 | FIG. 38 |

What is claimed is:

1. A light receiving member which comprises a support, a photosensitive layer and a surface layer, said photosensitive layer being composed of amorphous material containing silicon atoms and at least either germanium atoms or tin atoms and said surface layer being composed of amorphous material containing silicon atoms and at least one kind selected from oxygen atoms, carbon atoms and nitrogen atoms, said support having a surface provided with irregularities composed of spherical dimples, and an optical band gap being matched at the interface between said photosensitive layer and said surface layer.

2. A light receiving member as set forth in claim 1, wherein the photosensitive layer contains at least one kind selected from oxygen atoms, carbon atoms, and nitrogen atoms.

3. A light receiving member as set forth in claim 1, wherein the photosensitive layer contains a substance to control the conductivity.

4. A light receiving member as set forth in claim 1, wherein the photosensitive layer is of multi-layered structure.

5. A light receiving member as set forth in claim 1, wherein the photosensitive layer has as one of the constituent layers a charge injection inhibition layer containing a substance to control the conductivity.

6. A light receiving member as set forth in claim 1, wherein the photosensitive layer has as one of the constituent layers a barrier layer.

7. A light receiving member as set forth in claim 1, wherein the irregularities on the surface of the support are composed of spherical dimples having the same radius of curvature.

8. A light receiving member as set forth in claim 1, wherein the irregularities on the surface of the support are composed of spherical dimples having the same radius of curvature and the same width.

9. A light receiving member as set forth in claim 1, wherein the irregularities on the surface of the support are those which are formed by letting a plurality of rigid true spheres fall spontaneously on the surface of the support.

10. A light receiving member as set forth in claim 4, wherein the irregularities on the surface of the support are those which are formed by letting rigid true spheres of almost the same diameter fall spontaneously on the surface of the support from almost the same height.

11. A light receiving member as set forth in claim 1, wherein the spherical dimples have the radius of curvature R and the width D which satisfy the following equation.

$$0.035 \leqq D/R$$

12. A light receiving member as set forth in claim 6, wherein the spherical dimples have a width smaller than 500 μm.

13. A light receiving member as set forth in claim 1, wherein the support is a metal body.

14. An electrophotographic process oomprising:

(a) charging the light recieivng member of claim 1; and (b) irradiating said light receiving member with an electromagnetic wave carrying information, thereby forming an electrostatic image.

* * * * *

UNITED STATES PATENT AND TRADEMARK OFFICE

CERTIFICATE OF CORRECTION

PATENT NO. : 4,740,440

DATED : April 26, 1988

INVENTOR(S) : MITSURU HONDA, ET AL.

It is certified that error appears in the above-identified patent and that said Letters Patent is hereby corrected as shown below:

IN THE DRAWINGS

Figure 28:
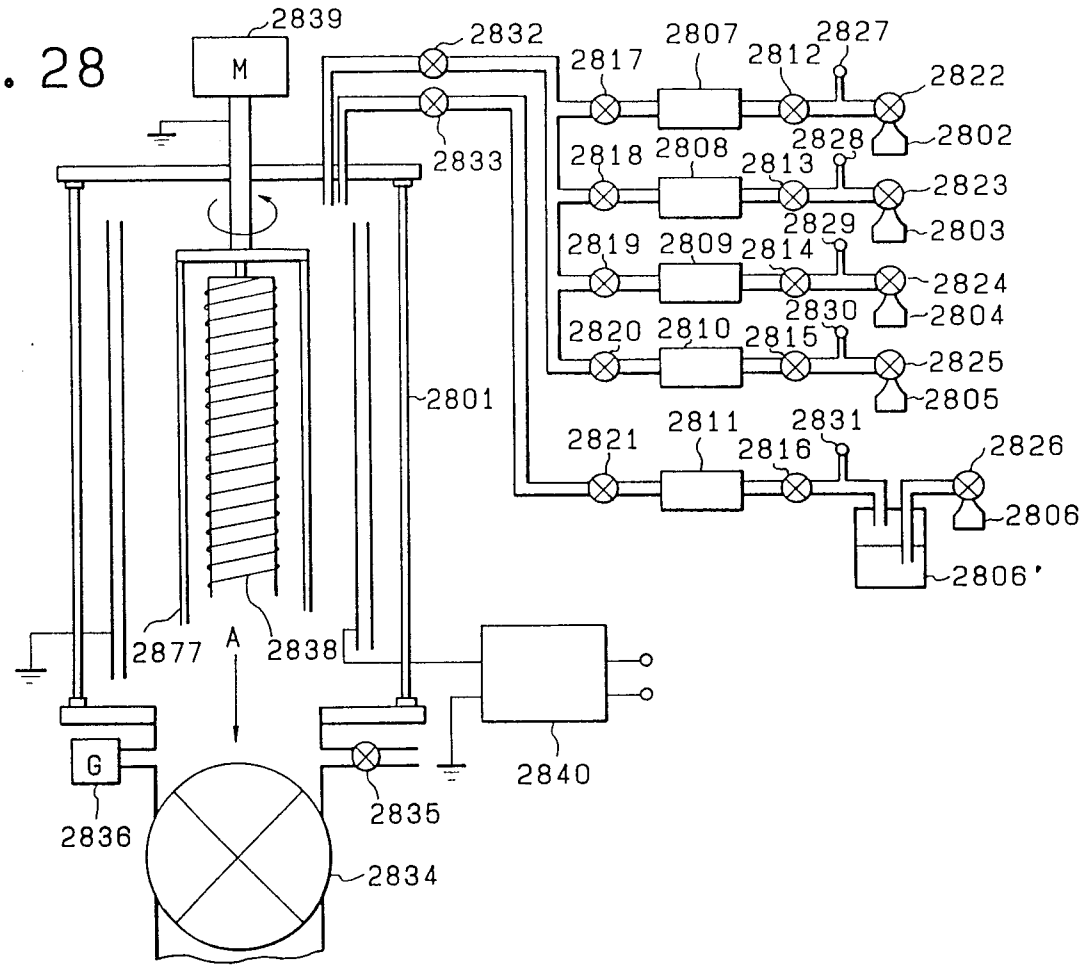
FIG. 28 is a schematic explanatory view of a fabrication device by glow discharging process as an example of the device for preparing the photosensitive layer and the surface layer respectively of the light receiving member according to this invention.

Sheet 15, Fig. 28, "2877" should read --2837--.
Sheet 30, Fig. 43 "$eF_4$ GAS" should read --$GeF_4$ GAS--.

COLUMN 18

Line 5, "5x104" should read --$5x10^4$--.

COLUMN 22

Line 30, "SiCL4," should read --$SiCl_4$,--.
Line 39, "HCL," should read --HCl,--.
Line 41, "$SiH_2CL_2$," should read --$SiH_2Cl_2$,--.

COLUMN 23

Line 22, "slicon" should read --silicon--.
Line 49, "HCL," should read --HCl,--.
Line 50, "$SiH_2CL_2$," should read --$SiH_2Cl_2$,--.
Line 51, "$SiHCL_3$," should read --$SiHCl_2$,--.
Line 52, "$GeHCL_3$," should read --$GeHCl_3$,--.
Line 53, "$GeH_2CL_2$, $GeH_3CL$," should read --$GeH_2Cl_2$, $GeH_3Cl$,--.
Line 55, "$GeCL_4$," should read --$GeCl_4$,--.

COLUMN 24

Line 1, "$SnCL_2$, $SnCL_4$," should read --$SnCl_2$, $SnCl_4$,--.
Line 5, "$SnCL_4$" should read --$SnCl_4$--.
Line 7, "$SnCL_4$" should read --$SnCl_4$--.

UNITED STATES PATENT AND TRADEMARK OFFICE

CERTIFICATE OF CORRECTION

PATENT NO. : 4,740,440

DATED : April 26, 1988

INVENTOR(S) : MITSURU HONDA, ET AL.

It is certified that error appears in the above-identified patent and that said Letters Patent is hereby corrected as shown below:

COLUMN 28

Line 50, "0.01" should read --0.001--.
Line 51, "0.001" should read --0.01--.

COLUMN 29

Line 53, "38" should read --28--.

COLUMN 30

Line 11, "2510" should read --2810--.
Line 29, "$B_2H_4/H_2$" should read --$B_2H_6/H_2$--.
Line 67, "$B_2H_2/H_2$" should read --$B_2H_6/H_2$--.

COLUMN 33

Table 3, "$H_2$ = $\longrightarrow$ 300" should read --$H_2$ = 0 $\longrightarrow$ 300--.

COLUMN 34

Table 4, "5th step $SiF_4$" should read --5th step $SiF_4$--.
$H_2$ $H_2$
$NH_2$ $NH_3$

UNITED STATES PATENT AND TRADEMARK OFFICE

CERTIFICATE OF CORRECTION

PATENT NO. : 4,740,440

DATED : April 26, 1988

INVENTOR(S) : MITSURU HONDA, ET AL.

It is certified that error appears in the above-identified patent and that said Letters Patent is hereby corrected as shown below:

COLUMN 35

Table 8,
"$SiH_4$ $SiH_4$ = 100 → "
$SnCl_4$/ 300
He $SnCl_4$/
He = 100 → 0
should read
--$SiH_4$ $SiH_4$ = 100 → 300--
$SnCl_4$/ $SnCl_4$/
He He = 100 → 0
Table 9, "NHhd 3 = 10" should read --$NH_3$ = 10--.

COLUMN 38

Line 10, "oomprising:" should read --comprising:--.
Line 11, "recieiving" should read --receiving--.

Signed and Sealed this

Twenty-fourth Day of January, 1989

*Attest:*

DONALD J. QUIGG

*Attesting Officer* *Commissioner of Patents and Trademarks*